US008409645B2

(12) United States Patent
Feldmeier et al.

(10) Patent No.: US 8,409,645 B2
(45) Date of Patent: Apr. 2, 2013

(54) FOOD PACKAGE FOR SEGREGATING INGREDIENTS OF A MULTI-COMPONENT FOOD PRODUCT

(75) Inventors: Daniel R. Feldmeier, Waunakee, WI (US); Metty Poei, Wilmette, IL (US); Mary Amanda Lamp, Waunakee, WI (US); Brian Patrick Lawless, Hawthorn Woods, IL (US); Paul Edward Doll, Madison, WI (US); David J. Smith, Needham, MA (US); Edward L. Dickinson, Littleton, MA (US); Patsy Anthony Coppola, Bedford, MA (US); Stephen K. Guerrera, Holliston, MA (US); Gregorio Ramon Maramba Abesames, North Andover, MA (US)

(73) Assignee: Kraft Foods Group Brands LLC, Northfield, IL (US)

( * ) Notice: Subject to any disclaimer, the term of this patent is extended or adjusted under 35 U.S.C. 154(b) by 505 days.

(21) Appl. No.: 12/272,933

(22) Filed: Nov. 18, 2008

(65) Prior Publication Data

US 2010/0124590 A1 May 20, 2010

(51) Int. Cl.
*B65D 81/32* (2006.01)

(52) U.S. Cl. ..... 426/115; 426/119; 426/120; 426/106; 426/394; 426/411; 229/80.5; 229/87.08; 229/87.09; 229/87.11

(58) Field of Classification Search ..... 426/115, 426/119, 120, 394, 106, 420, 129, 410–412; 229/80.5, 87.11, 80, 81, 87.08–87.09; 206/219, 206/568, 551; 220/744, 211
See application file for complete search history.

(56) References Cited

U.S. PATENT DOCUMENTS

| | | | | |
|---|---|---|---|---|
| 1,476,604 | A * | 12/1923 | Foreman | 242/395 |
| 2,510,211 | A | 6/1950 | Cleary | |
| 3,145,112 | A | 8/1964 | Boegershausen | |
| 3,756,389 | A | 9/1973 | Firth | |
| 3,883,068 | A | 5/1975 | Silver | |

(Continued)

FOREIGN PATENT DOCUMENTS

| | | |
|---|---|---|
| DE | 3247151 | 6/1984 |
| DE | 3423459 | 2/1986 |

(Continued)

OTHER PUBLICATIONS

Cazacu, Corneliu; EP Search Report; Feb. 3, 2010; 4 pages.

(Continued)

*Primary Examiner* — Drew Becker
*Assistant Examiner* — Luana Z Long
(74) *Attorney, Agent, or Firm* — Fitch, Even, Tabin & Flannery LLP

(57) ABSTRACT

A food package for segregating ingredients of a multi-component food product, such as the multiple components of a sandwich, the package comprising an outer container to house a first food component and at least one flexible envelope or barrier film layer that encloses at least one intermediate food component allowing for separation of the intermediate food component during extended periods of storage and prior to opening the product. A method for opening the package comprises applying a pulling force to an externally located protruding end portion of the envelope, such that the envelope peels apart and separates into ruptured layers that are pulled out of the food product and out of the outer container by the continual pulling force from the protruding end portion.

33 Claims, 15 Drawing Sheets

U.S. PATENT DOCUMENTS

| | | | | |
|---|---|---|---|---|
| 3,983,994 | A | 10/1976 | Wyslotsky | |
| 4,137,333 | A * | 1/1979 | Daswick | 426/120 |
| 4,154,860 | A | 5/1979 | Daswick | |
| 4,269,345 | A | 5/1981 | Emery | |
| 4,589,553 | A | 5/1986 | Ferrero | |
| 4,623,568 | A | 11/1986 | Suzuki | |
| 4,648,506 | A | 3/1987 | Campbell | |
| 4,844,330 | A | 7/1989 | Roosa et al. | |
| 4,951,866 | A | 8/1990 | Rusnak | |
| 5,012,971 | A | 5/1991 | Cozzi et al. | |
| 5,039,001 | A | 8/1991 | Kinigakis et al. | |
| 5,039,003 | A | 8/1991 | Gordon et al. | |
| 5,045,333 | A | 9/1991 | Petrofsky et al. | |
| 5,213,256 | A | 5/1993 | Cyr | |
| 5,221,566 | A | 6/1993 | Tokoh et al. | |
| 5,439,717 | A | 8/1995 | Lustig et al. | |
| 5,503,858 | A | 4/1996 | Reskow | |
| 5,567,455 | A | 10/1996 | Alsbrook, Sr. | |
| 5,676,244 | A | 10/1997 | Green et al. | |
| 5,860,544 | A | 1/1999 | Brucker | |
| 5,962,052 | A | 10/1999 | Acknin et al. | |
| 6,007,264 | A | 12/1999 | Koptis | |
| 6,048,558 | A | 4/2000 | Feldmeier et al. | |
| 6,062,468 | A | 5/2000 | Tausanovitch | |
| 6,089,375 | A | 7/2000 | Johnson et al. | |
| 6,203,535 | B1 | 3/2001 | Barney et al. | |
| 6,228,406 | B1 | 5/2001 | Borzuta | |
| 6,464,821 | B1 | 10/2002 | Phillips et al. | |
| 6,544,569 | B1 | 4/2003 | Suzuki et al. | |
| 6,602,528 | B1 * | 8/2003 | Wells | 426/120 |
| 6,702,178 | B2 | 3/2004 | Bowers et al. | |
| 6,764,700 | B2 | 7/2004 | Lamp et al. | |
| 7,172,066 | B2 | 2/2007 | Peuker et al. | |
| 7,240,797 | B1 | 7/2007 | Grossman | |
| 2002/0058091 | A1 | 5/2002 | Kortum | |
| 2002/0150658 | A1 | 10/2002 | Morrissette et al. | |
| 2006/0269174 | A1 | 11/2006 | Huffer | |
| 2007/0237862 | A1 * | 10/2007 | Pinkston | 426/106 |

FOREIGN PATENT DOCUMENTS

| | | | |
|---|---|---|---|
| DE | 4216450 | | 11/1993 |
| DE | 19616414 | | 1/1998 |
| DE | 19930102 | | 3/2000 |
| DE | 19920077 | | 11/2000 |
| DE | 19946257 | | 4/2001 |
| DE | 20101650 | | 4/2001 |
| EP | 0515795 | A1 | 2/1992 |
| EP | 0488531 | | 6/1992 |
| EP | 0533379 | A1 | 3/1993 |
| EP | 0818399 | A1 | 1/1998 |
| EP | 0893952 | | 2/1999 |
| EP | 1050212 | | 11/2000 |
| EP | 1145636 | | 10/2001 |
| EP | 1186549 | | 3/2002 |
| EP | 1398278 | A1 | 3/2004 |
| EP | 1518796 | A1 | 3/2005 |
| EP | 1595811 | A1 | 11/2005 |
| EP | 1693044 | A1 | 8/2006 |
| EP | 1900642 | A1 | 3/2008 |
| GB | 2285791 | A | 7/1995 |
| GB | 2328431 | | 2/1999 |
| GB | 2376220 | A | 12/2002 |
| JP | 3124575 | A | 5/1991 |
| JP | 9095363 | A | 4/1997 |
| JP | 9095364 | A | 4/1997 |
| JP | 9254987 | A | 9/1997 |
| JP | 11240567 | A | 9/1999 |
| JP | 2001328684 | A | 11/2001 |
| JP | 2003153658 | A | 5/2003 |
| JP | 2004166567 | A | 6/2004 |
| JP | 2006027627 | A | 2/2006 |
| JP | 2006198250 | A | 8/2006 |
| WO | 9205090 | A1 | 4/1992 |
| WO | 9218044 | | 10/1992 |
| WO | 9419257 | | 9/1994 |
| WO | 9533621 | A1 | 12/1995 |
| WO | 9740693 | | 11/1997 |
| WO | 9742897 | A1 | 11/1997 |
| WO | 9818689 | A1 | 5/1998 |
| WO | 02080623 | A1 | 10/2002 |
| WO | 02083504 | A1 | 10/2002 |
| WO | 2004086886 | A1 | 10/2004 |
| WO | 2005037679 | A1 | 4/2005 |
| WO | 2006028789 | A2 | 3/2006 |

OTHER PUBLICATIONS

Cazacu, Corneliu; EP Search Report; Jan. 21, 2010; 3 pages.
Cazacu, Corneliu; EP Search Report; Feb. 3, 2010; 3 pages.
Cazacu, C.; European Search Opinion; EP09252563.3 dated Mar. 22, 2010; 3 pages (corresponds to U.S. Appl. No. 12/272,933).
Cazacu, C.; European Search Opinion; EP09252537.7 dated Feb. 15, 2010; 2 pages.
Cazacu, C.; European Search Opinion; EP09252620.1 dated May 7, 2010; 4 pages.
Cazacu, C.; Communication regarding Grant of Patent; EP09252620.1 dated Jun. 10, 2011; 4 pages.

* cited by examiner 10
38
18
24
141
121
15
26

A
38
18
24
14
20b
20a
12
15
22
141
121
26
B

A
38
18
24
16
20b
14
20a
12
141
121
15
22
26
B 10
12
14
15
16
18
20a
20b
22
24
26
38
121
141
A
B

FOOD PACKAGE FOR SEGREGATING INGREDIENTS OF A MULTI-COMPONENT FOOD PRODUCT

FIELD

The present disclosure relates generally to a food package, and more specifically to a food package for segregating ingredients of a multi-component food product, such as the multiple components of a sandwich.

BACKGROUND

Multi-component food products, such as sandwich products, are often prepared and eaten the same day or within a few days to avoid storage issues and loss of organoleptic properties of a freshly-made sandwich upon storage. When a sandwich product is prepared and stored for an extended period of time, e.g., more than a few days, there is typically undesirable moisture and flavor migration between the bread of the sandwich and the inner sandwich components, or garnish/toppings, of the sandwich. The inner sandwich components that have higher water activities than adjacent components or the bread components can have moisture that tends to migrate towards the lower water activity food component. During an extended period of storage time, this moisture migration can result in a sandwich that is not as organoleptically pleasing due to issues such as bread becoming soggy, sandwich components losing their texture or crispness, sandwich components losing their flavor, and the like.

As a result, sandwich products that are meant to be stored for an extended period of time have been packaged in ways to try and minimize such moisture and flavor migration between the various components of the sandwich. One such example is to individually and separately package each component of the sandwich, such that the cheese is packaged or wrapped individually and separately from the meat which is also separately packaged, while the bread or bun component is also packaged separately from all of the inner sandwich components. While this may result in preventing the moisture and flavor migration between the components during the extended storage period, it can require the consumer to have to unwrap each component individually and to assemble the sandwich themselves before eating. This can require multiple, time-consuming preparation steps on the part of the consumer, e.g., opening all of the individually wrapped packages and then assembling all of the sandwich components into a sandwich.

Another aspect is described in U.S. Pat. Nos. 5,012,971 and 5,213,256, which consist of a preassembled sandwich or burger that is packaged in a container, such as a Styrofoam hinged container having a top half and a bottom half, where the top half of the bun or top bread component is contained inside the top part of the container, and the bottom bun or bottom bread component is contained inside the bottom part of the container. A card or insert is placed between the top and bottom bread components, such that it separates the top and bottom half of the container, and is positioned such that it can separate two inner sandwich components, such as separating a cheese and a meat component. When the container is in a closed position, the sandwich or burger is in a pre-assembled state therein with the insert or card placed between the two inner sandwich components essentially creating two separate compartments within the container.

Thus, the insert card creates a separately packaged top half of the sandwich, and a separately packaged bottom half of the sandwich. When the consumer is ready to consume the sandwich, they simply grasp the insert or card, preferably it will have a tab for grasping, and pull the insert in a horizontal direction to remove it from the container and from between the sandwich halves. However, the insert only divides the sandwich into two halves, without segregating the inner sandwich components completely. Only one surface or side of an inner sandwich component is segregated from an adjacent surface or side of another sandwich component; the other side of the inner sandwich component is still in contact with the remainder of the sandwich on its half of the container, such that moisture and flavor migration issues can still be prevalent on that half or side of the sandwich. Furthermore, certain food components like cheese, for example, are sticky, i.e., can have a high static coefficient of friction, thus preventing removal of the divider by a simple sliding motion, or causing the food ingredient, such as cheese, to stick to the divider and to be pulled with it.

Still another variation is disclosed in International Publication Number WO 2004/086886, for a package used for retaining the filling of a roll, where the filling can be in a semi-solid state and it can be runny and difficult to maintain in a bread roll. A cavity can be made in the roll into which the packaged filling is placed, where the package can be shaped to compliment the cavity in the roll. Once the consumer is ready to consume the product, pressure is applied to one end of the package (i.e., the end that is visible and extends out from the opening in the roll), such as by squeezing the package, in order to push the filling out through an exit opening or hole in the opposite end. Once the filling has been pushed into the cavity of the roll, then the consumer must pull the remaining package out from the roll. Despite this food product being relatively pre-assembled, the method of removing the package and squeezing the filling into the cavity of the roll as the package is being removed creates an additional step for the consumer in assembling the sandwich, can be difficult to properly execute, and can be messy. Furthermore, the filling is essentially being pushed or squeezed out of the package.

SUMMARY

A package for segregating two or more component parts that are combined to make a product, the components being separated by a barrier material, and in particular, a food package for segregating ingredients of a multi-component food product, such as components of a sandwich, is provided that allows for the sandwich to be relatively pre-assembled yet substantially segregating the inner sandwich components from each other and from the bread components during storage of the sandwich. The inner sandwich components are segregated by a flexible envelope which substantially encloses the sandwich component during storage, while the overall sandwich, including the outer bread components, are stored in a rigid outer container. The flexible envelope encloses the inner sandwich component, which is placed inside of the bread component, where together these components are then packaged in the rigid outer container. Prior to consumption, a consumer can pull on or apply a force to a protruding end portion of the flexible envelope, or pull tab, which peels apart a rupturable seal of the envelope and exposes the sandwich component to the bread component, and any other sandwich components that may be present and removed from their respective envelopes, thus assembling the sandwich due to the force of gravity acting upon it without requiring the consumer to de-assemble or re-assemble the sandwich.

The inner sandwich components are each segregated from each other by their respective flexible envelopes, as well as being segregated from the bread components. As a result, moisture migration and flavor migration can be restricted during storage of the assembled sandwich and the organoleptic properties of the sandwich can be maintained. Additionally, since the overall sandwich is packaged in a rigid outer container, the bread component can be stored without significantly compromising its organoleptic properties, while also packaging the inner sandwich components in their own individual envelopes placed between the bread components. Such packaging technique extends the period of time that the assembled, yet segregated, sandwich can be maintained and stored prior to consumption. Furthermore, a simple, one-step action is required to "open" multiple envelopes, thus exposing the inner sandwich components and creating a sandwich that is ready to be eaten once the rigid outer container is opened. The sandwich is thus fully assembled with minimal preparation steps by the consumer without having significantly compromised organoleptic properties of the sandwich upon storage.

The envelope provided to enclose the sandwich components can be sealed on all or substantially all sides with a rupturable seal. The envelope can conform in shape to the food component and/or to the bread component or can have any other shape. The protruding end portion can be a continuation of the envelope or can be affixed to it, such that the protruding end portion extends from the sandwich and rigid outer container. Upon opening the envelope, the pull tab can be pulled such that the trailing edge of the envelope can begin to separate by partially rolling back upon itself.

Other envelope embodiments are also possible. In one aspect, the envelope can comprise two pull tabs, one on each opposing end, such that the envelope can be pulled away from the food product. In another aspect, the envelope can comprise a middle, or intermediate layer, to which an upper and lower layer of the envelope are attached. In still another aspect, the pull tab can be laminated to a layer of the envelope and defined by a weakened area that can separate the pull tab from the layer of the envelope upon applying a force to its protruding end.

Additionally, the bread component can also have a layer of film that encloses and separates the bread from the other sandwich components. This bread film layer can be attached to flanges of the container. As a result, the envelope layers can either be sealed to the bread film layer itself or at least one layer of the envelope can also be sealed to the flanges. Moreover, the pull tab can be an extension of a film layer attached to the envelope layers and bread layers at a trailing end thereof, such that the pull tab comprises multiple film layers that can be combined to form the pull tab.

In another aspect, the protruding end portion of the envelope can be wound around a roller or spool housing with its end free for grasping, such that as the end of the protruding end portion is pulled the spool is rotated thus activating the protruding end portion and applying a force to the layers of the flexible envelope, which initiates the peeling of the seals of the envelope. The discarded layers of the envelope are subsequently wound around the spool as the protruding end portion is continually pulled, such that the discarded layers can be hidden from view and wrapped around the spool.

In still another aspect, the protruding end portion of the envelope is wrapped around a spool that has a knob for turning, such that the protruding end portion is not visible to the consumer. In order to apply force to the envelope to peel apart the seals, the knob is rotated axially, such that as the knob is turned the seals of the envelope are also pulled apart and peel to expose the inner sandwich components, and the discarded layers of the envelope are wound around the spool and are hidden from view.

In yet another aspect, the protruding end portion of the envelope passes through a secondary compartment within the rigid outer container and an end segment of the protruding end portion extends through an opening in the secondary compartment, where the end segment is to be accessed by the consumer. The end segment of the protruding end portion can be grasped by the consumer and pulled to peel apart the seals of the envelope and expose the inner sandwich components to each other and to the bread. As the envelopes peel, the discarded envelope layers are pulled into the secondary compartment of the outer container and are contained therein and hidden from view.

In another aspect, the food package can comprise a unitary compartment of the container that houses a bread component with the sandwich components suspended inside above the bread component on a barrier film layer. The barrier layer can be configured to rupture upon heating such that the segregated sandwich component can then be combined with the bread component.

A method of opening the package is provided that allows a one-step action for opening the packaged sandwich components and to obtain a completely assembled sandwich. To open the envelope which encloses the sandwich component to result in a completely assembled sandwich, the consumer can apply a force to the protruding end portion either by pulling on the protruding end portion or by rotating a knob axially that has a portion of the protruding end portion thereon. This pulling or rotating action applies a force to the envelopes, thus peeling apart the seals and separating the layers of the envelope from each other and exposing the sandwich components to the inner components of the sandwich. As the protruding end portion is pulled and the layers of the envelopes are separated, the ruptured layers of the envelope are pulled from between layers of the sandwich and rigid container, allowing all of the inner sandwich components to fall into place, thus resulting in the fully assembled sandwich. The rigid container can then be opened to access the sandwich.

DETAILED DESCRIPTION OF THE DRAWINGS

A package for segregating ingredients of a multi-component food product, such as multiple components of a food sandwich, the package having an outer container, that can be rigid, semi-rigid, or flexible, for storing a pair of bread components and one or more flexible envelopes for enclosing a food or sandwich component therebetween, and methods for opening, are disclosed herein and illustrated in FIGS. 1-25. In particular, the outer container has at least one compartment and can have a top compartment and a bottom compartment, where one compartment receives one of the pair of bread components of the sandwich and the other compartment receives the other bread component. At least one flexible envelope can be positioned between the bread components to enclose a sandwich component, where one envelope may be used for each sandwich component contained therebetween. Alternatively, more than one sandwich component can be enclosed within the envelope where migration between the components is not an issue. The flexible envelope substantially completely encloses the sandwich component and can be sealed along a rupturable seal. Aspects of the container and its flexible envelopes will be discussed in terms of a sandwich and sandwich components. However, it will be understood that any multi-component food product can be packaged in this way, or any multi-component non-food product. For instance, the outer container of the package can store a first food component and a second food component having one or more flexible envelopes for enclosing an intermediate food component therebetween.

Figures 4, 5, 6, 7, 8:
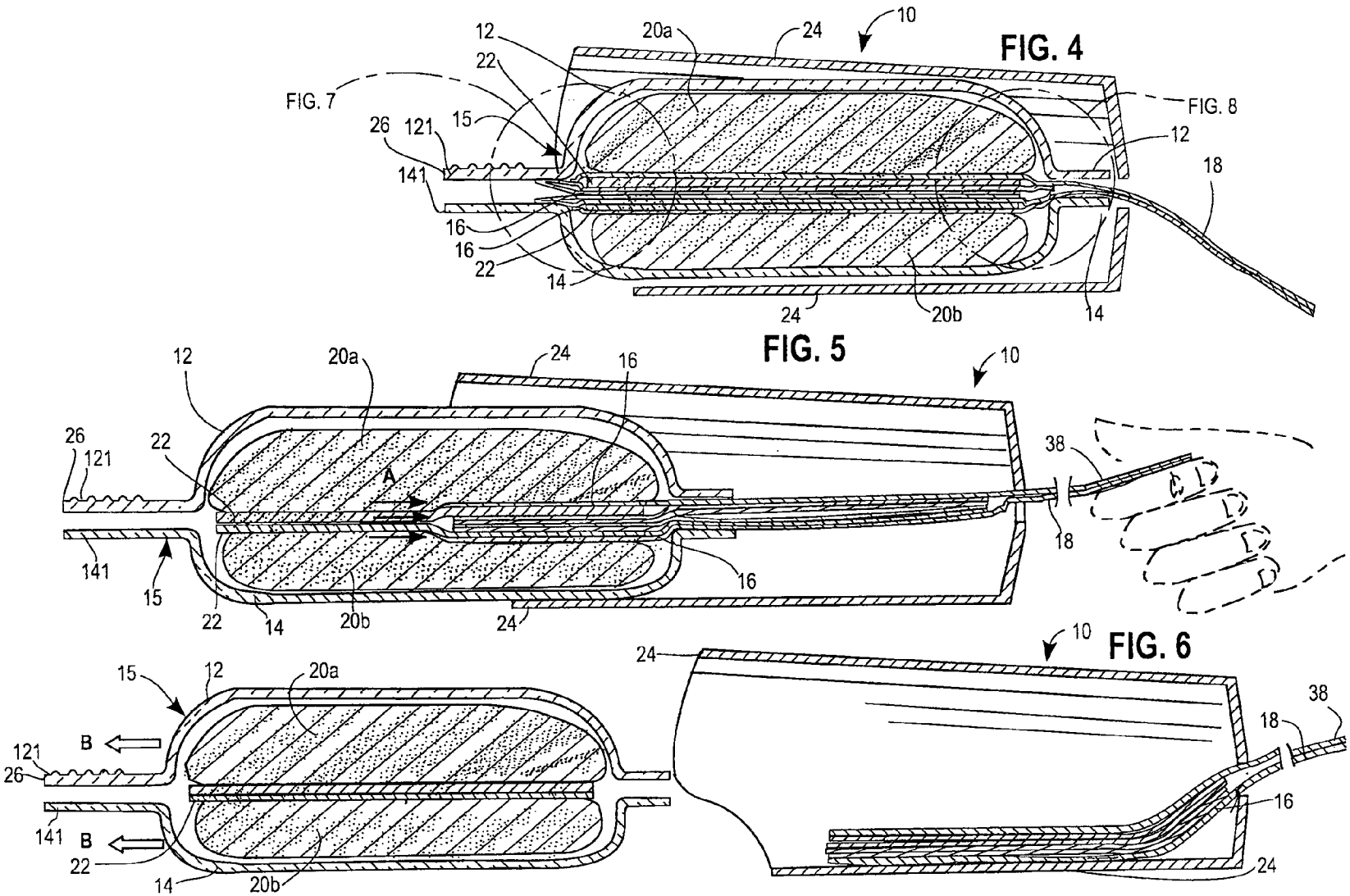
FIG. 4 is a cross-sectional side view of the food package of FIG. 1.
FIG. 5 is a cross-sectional view of the food package of FIG. 2.
FIG. 6 is cross-sectional view of the food package of FIG. 3.
FIG. 7 is a detailed cross-sectional view of one side of the food package of FIG. 4 as indicated by the expanded area.
FIG. 8 is a detailed cross-sectional view of another side of the food package of FIG. 4 as indicated by the expanded area.
Figure 7:
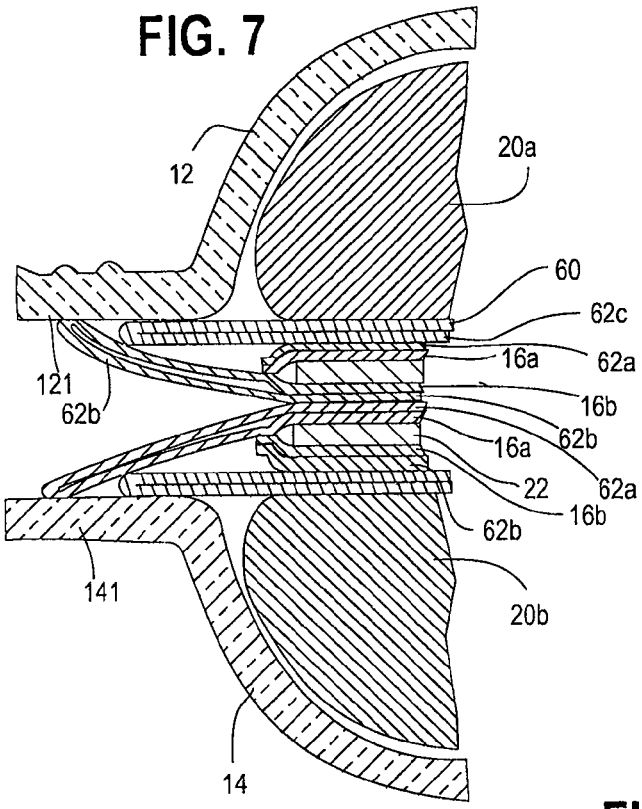
Figure 8:
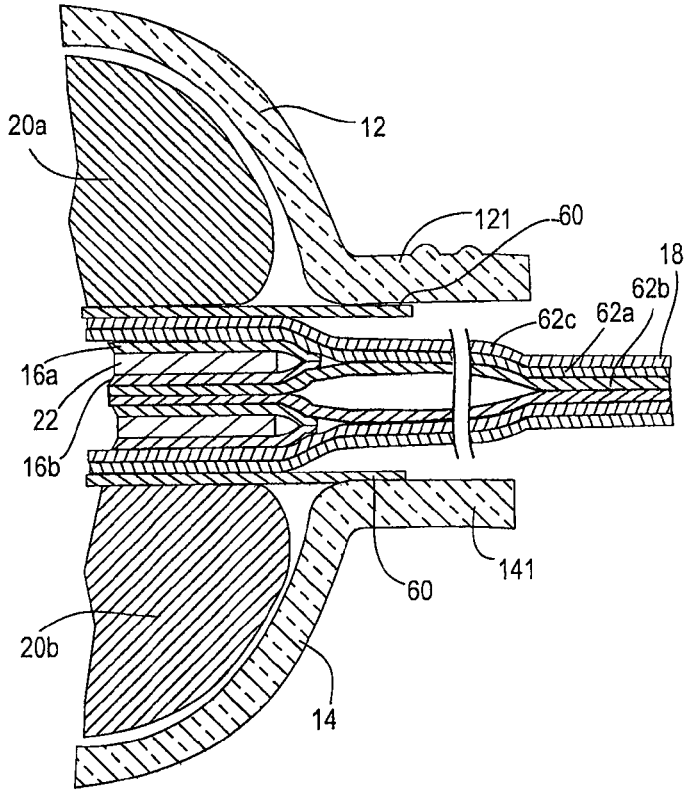
Figure 9:
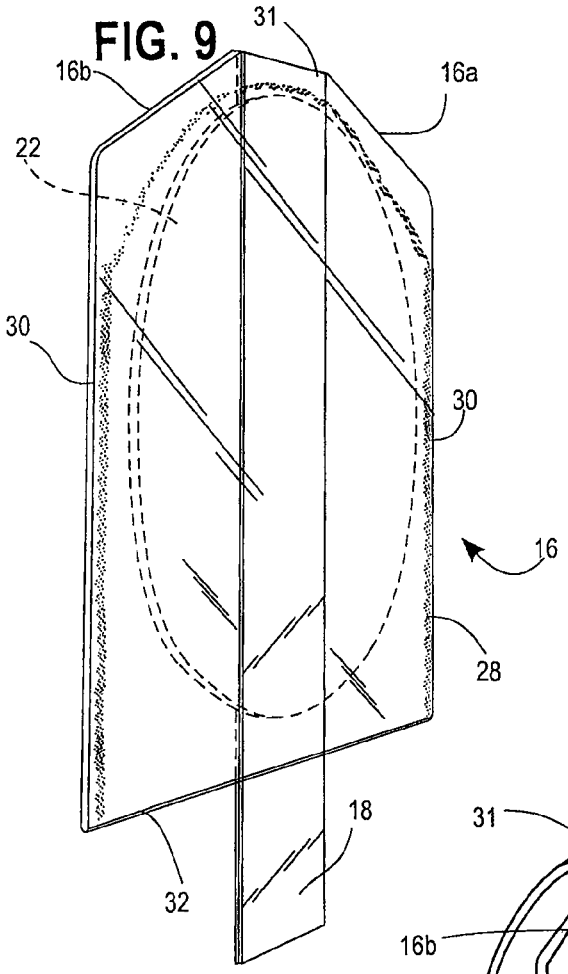
FIG. 9 is a perspective view of an envelope for enclosing a sandwich component.
Figure 10:
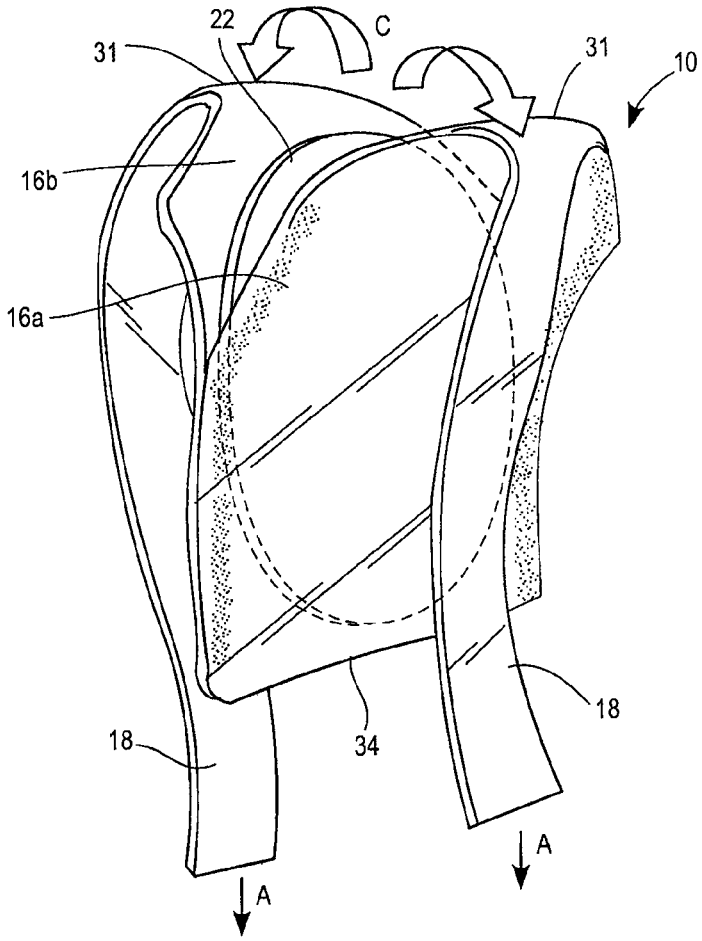
FIG. 10 is a perspective view of the envelope of FIG. 9 as it is being opened.
Figure 11:
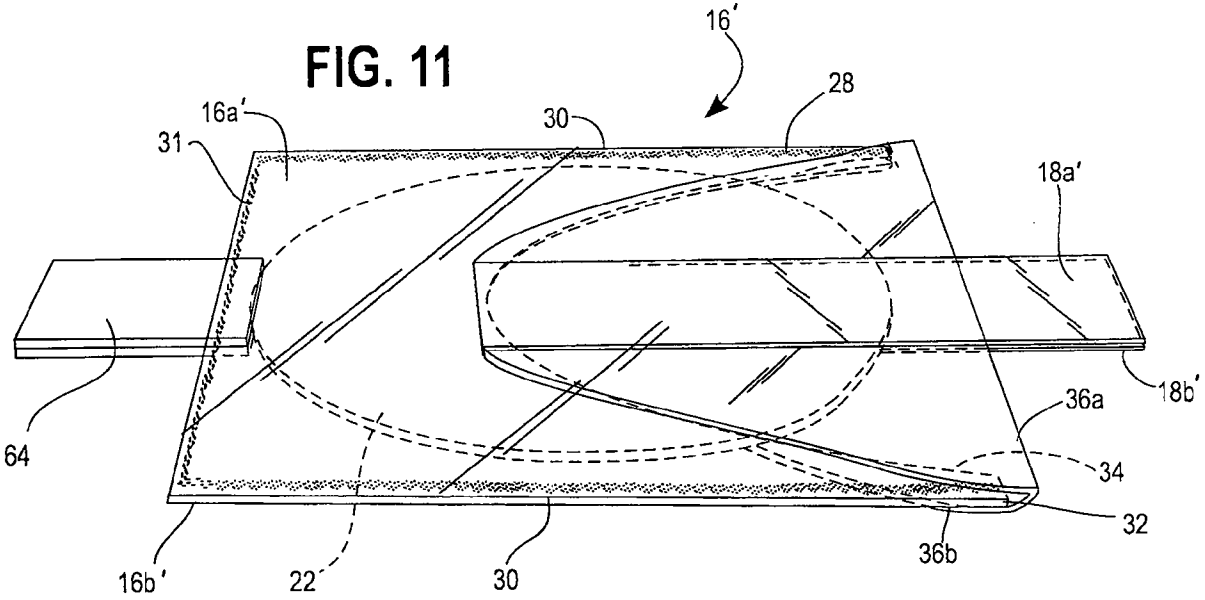
FIG. 11 is a perspective view of a second embodiment of an envelope for enclosing a sandwich component.
Figure 12:
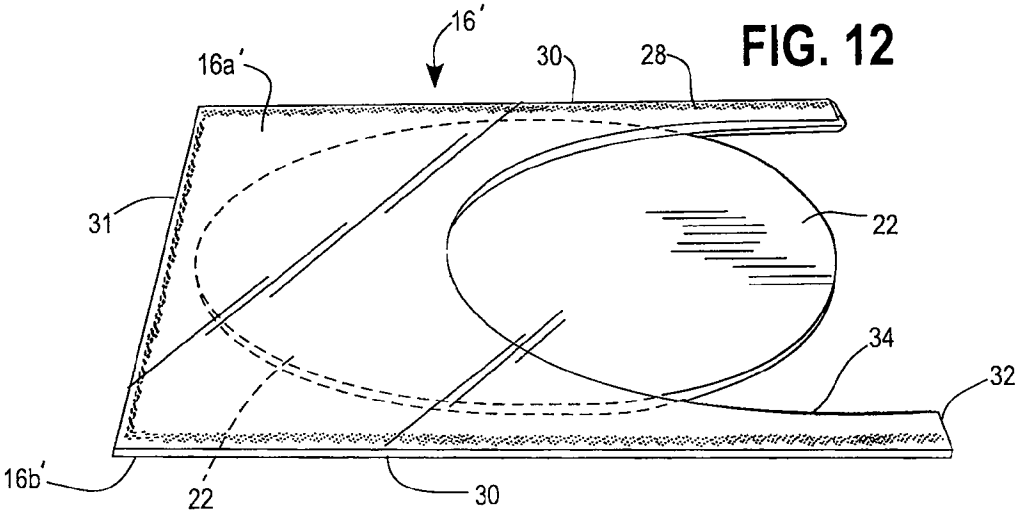
FIG. 12 is a perspective view of the envelope of FIG. 11 as it is being opened.

FIGS. 1-8 show a first embodiment of a food package having a rigid outer container for storing food components therebetween and having one or more flexible envelopes for enclosing sandwich components. FIGS. 4-8 show a cross-sectional view of the first embodiment, with FIGS. 7-8 showing an expanded and more detailed view of the envelope layers. FIGS. 9-10 show a first embodiment of a flexible envelope having a tapered end and a protruding end portion or pull tab attached to the envelope at the tapered end. The tapered end, or trailing edge, is pulled against when a force is applied to the pull tab and separation of the envelope layers begins at this point. FIGS. 11-12 show a second embodiment of the envelope where the envelope can have a cut out area with a flap attached to cover the cut out area. The envelope can be pulled on two ends, via a pull tab and a pull strip, such that the pull tab removes the flap from the envelope and the pull strip pulls the remaining envelope away from around the sandwich component.

Figure 13:
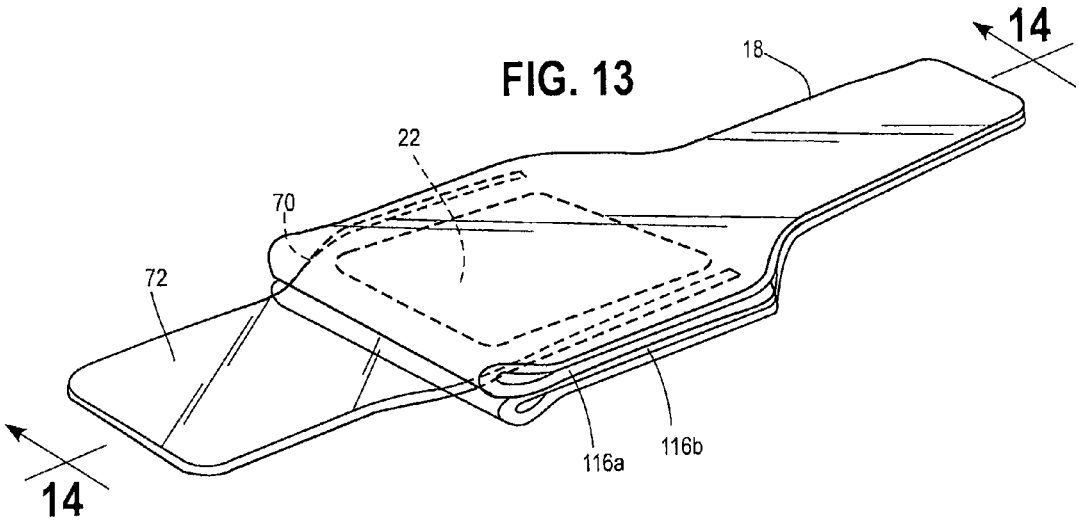
FIG. 13 is a perspective view of a third embodiment of an envelope for enclosing a sandwich component.
Figure 14:
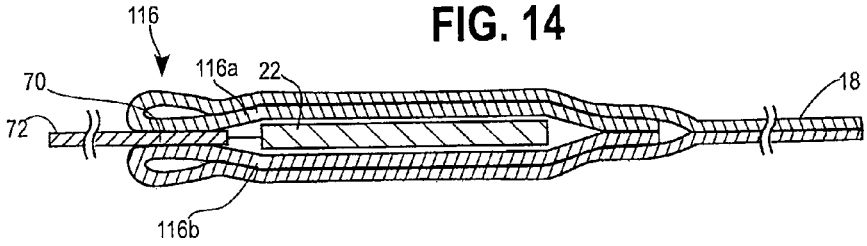
FIG. 14 is a cross-sectional view of the envelope of FIG. 13 taken along line 13-13.
Figure 15:
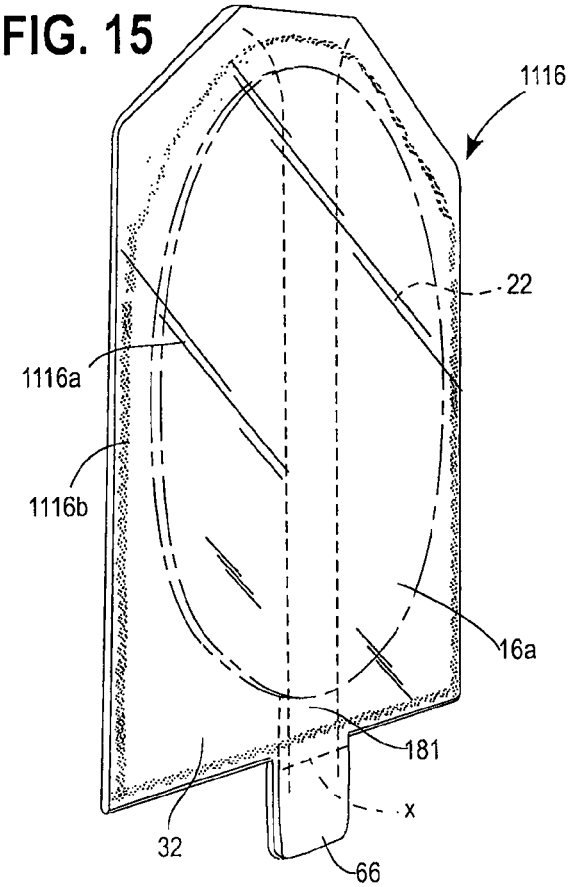
FIG. 15 is a perspective view of a fourth embodiment of an envelope for enclosing a sandwich component.
Figure 16:
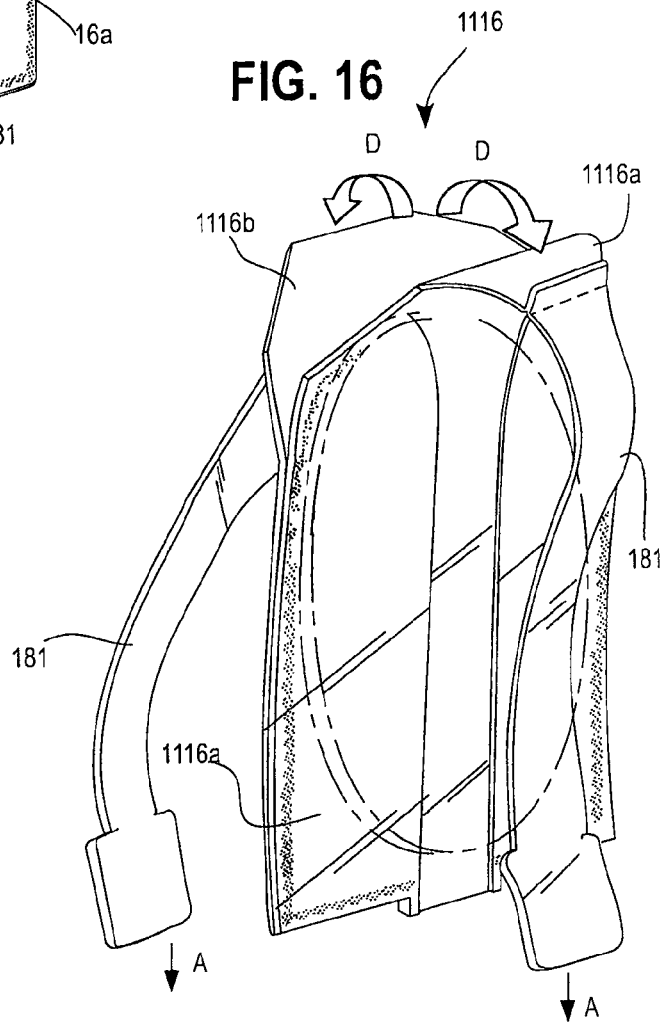
FIG. 16 is a perspective view of the envelope of FIG. 15 as it is being opened.

FIGS. 13-14 depict a third embodiment where the envelope comprises three layers, the upper and lower layer with an intermediate layer therebetween. The upper and lower layers seal directly to the intermediate layer. Each end of the envelope can have a pull tab or strip. FIGS. 15-16 depict a fourth embodiment of the envelope where the pull tab is laminated to the envelope layers and can be later removed to assist in pulling the layers apart. FIGS. 17A-D depict a fifth embodiment of the envelope layers in relation to a compartment layer.

Figure 18:
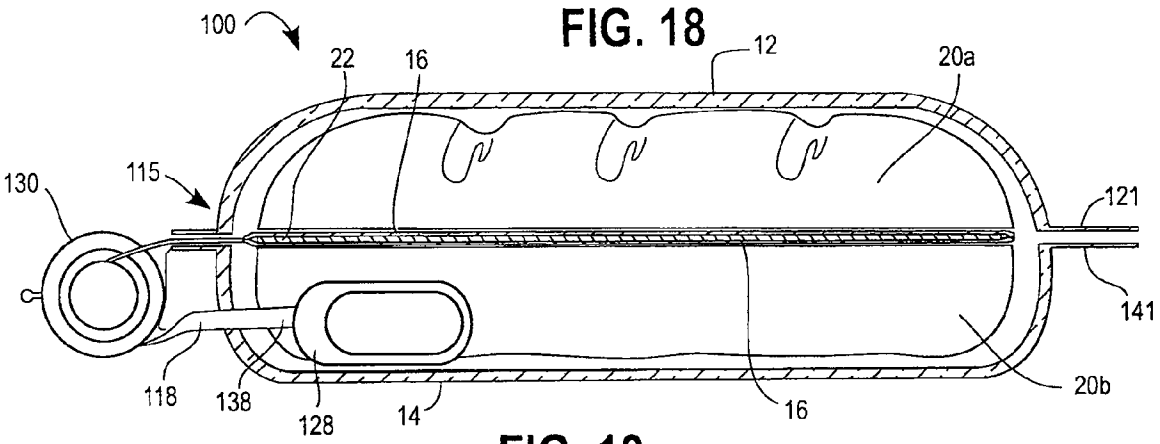
FIG. 18 is a cross-sectional view of a second embodiment of a food package for segregating inner sandwich components of a sandwich within envelopes that are in an unopened state.
Figure 19:
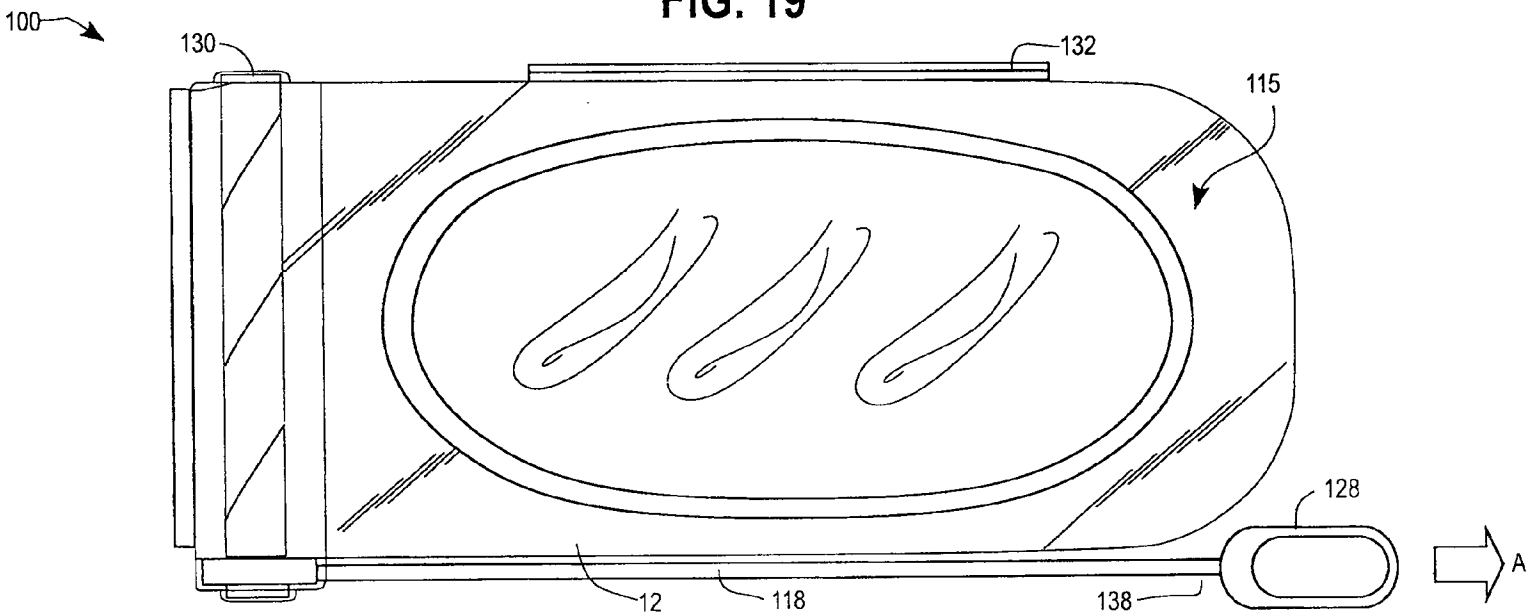
FIG. 19 is a top elevational view of the food package of FIG. 18 where the packaged sandwich components are in a partially open state.
Figure 20:
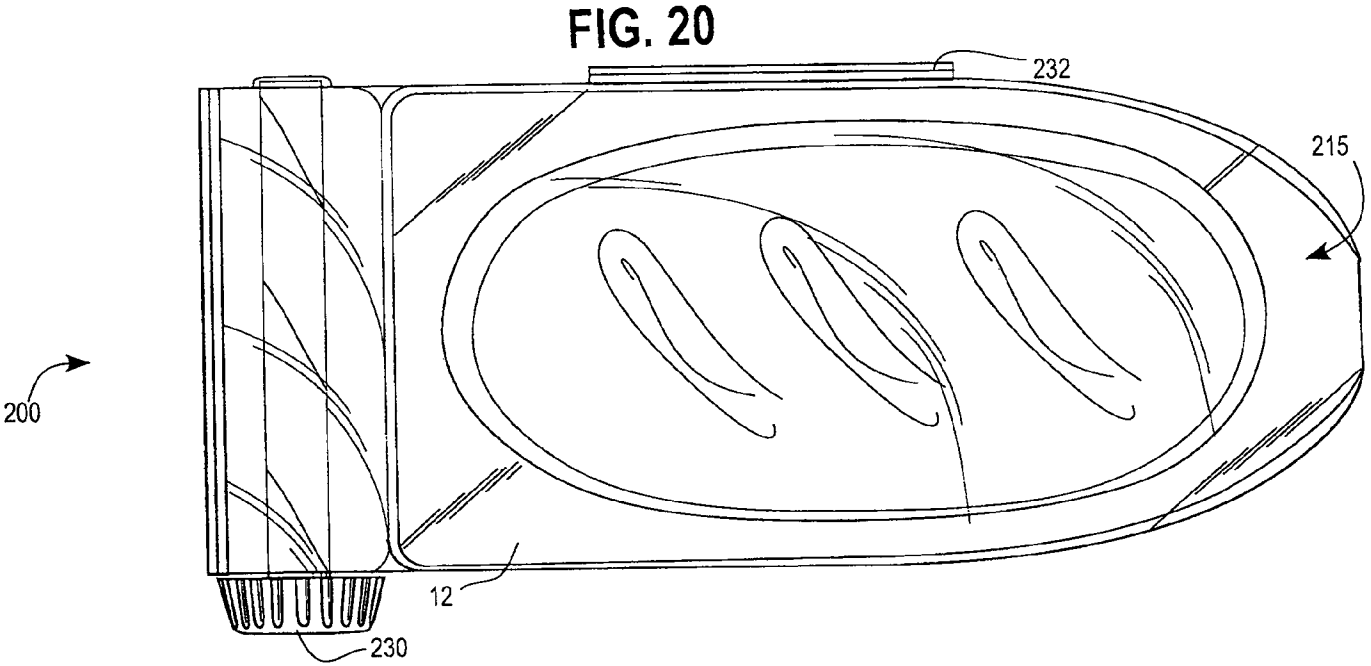
FIG. 20 is a top elevational view of a third embodiment of a food package for segregating inner sandwich components of a sandwich within envelopes that are in an unopened state.
Figure 21:
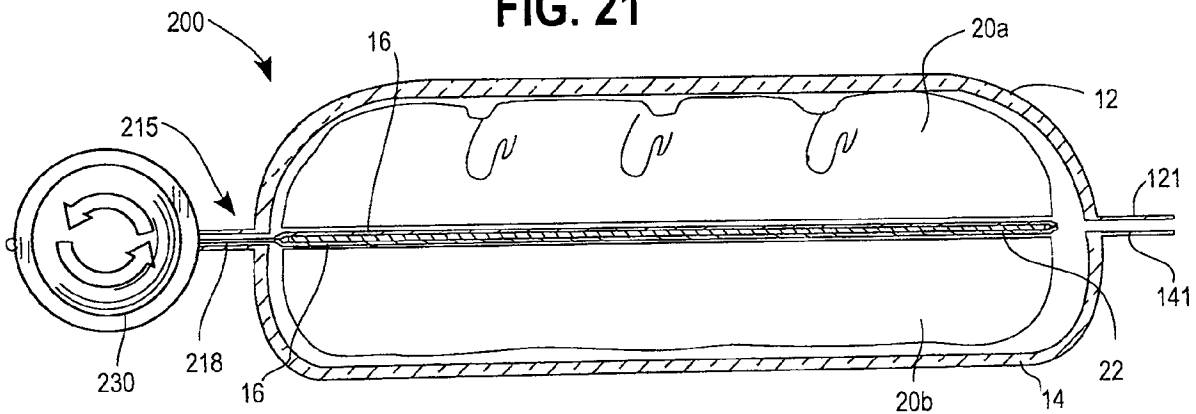
FIG. 21 is a cross-sectional view of the food package of FIG. 20.
Figure 22:
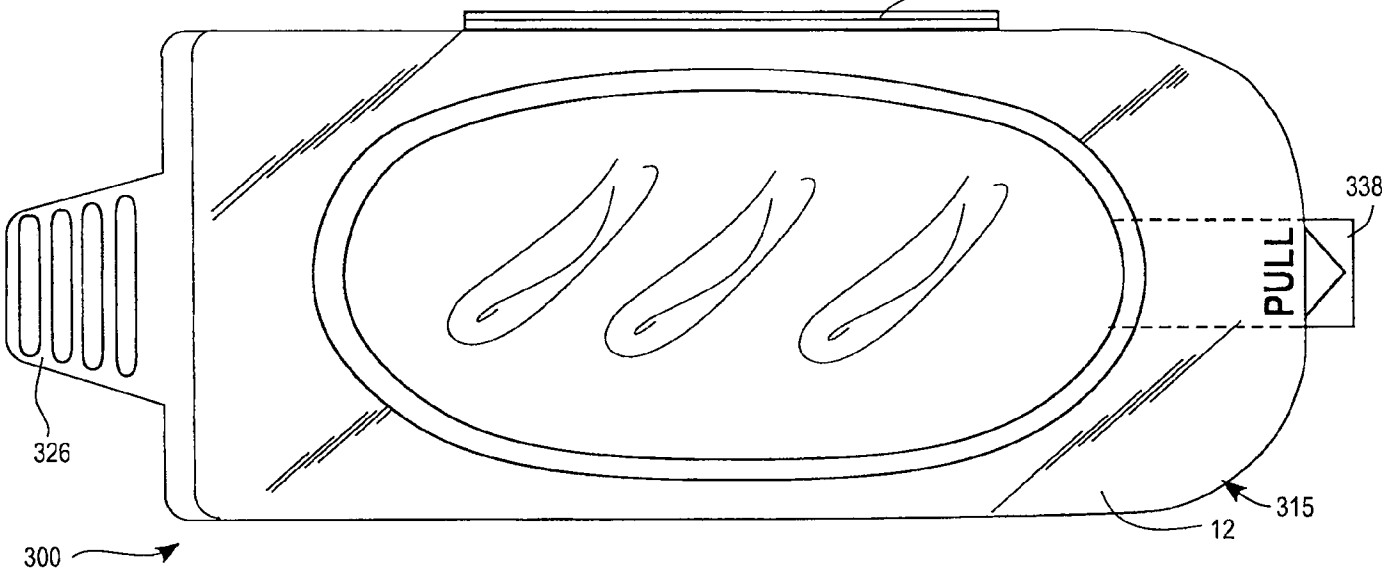
FIG. 22 is a top elevational view of a fourth embodiment of a food package for segregating inner sandwich components of a sandwich within envelopes that are in an unopened state.
Figure 23:
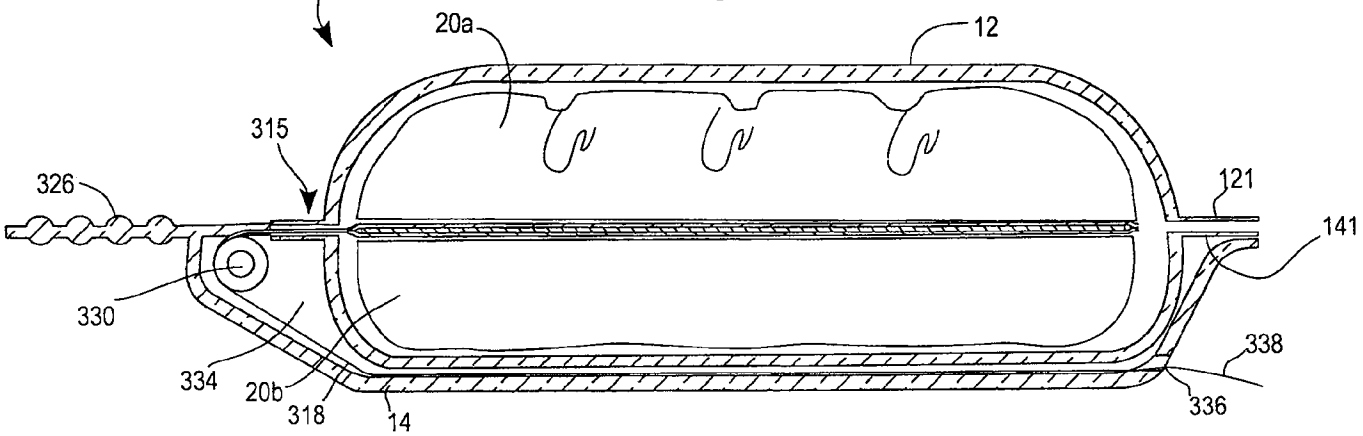
FIG. 23 is a cross-sectional view of the food package of FIG. 22.
Figure 24:
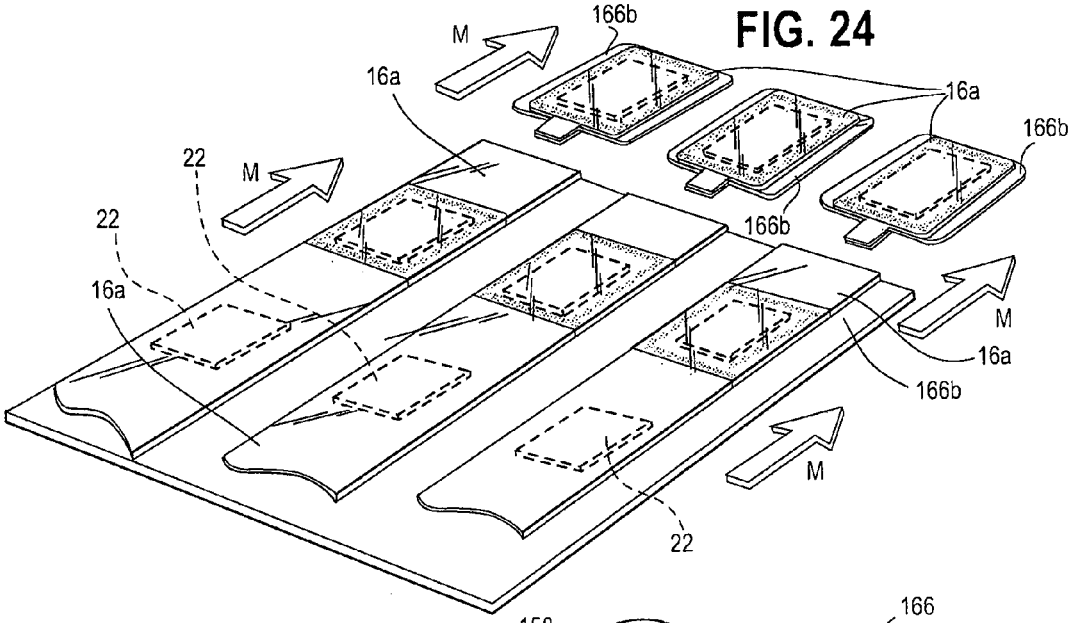
FIG. 24 is a portion of a process line depicting the process of enclosing sandwich components within an envelope.
Figure 25:
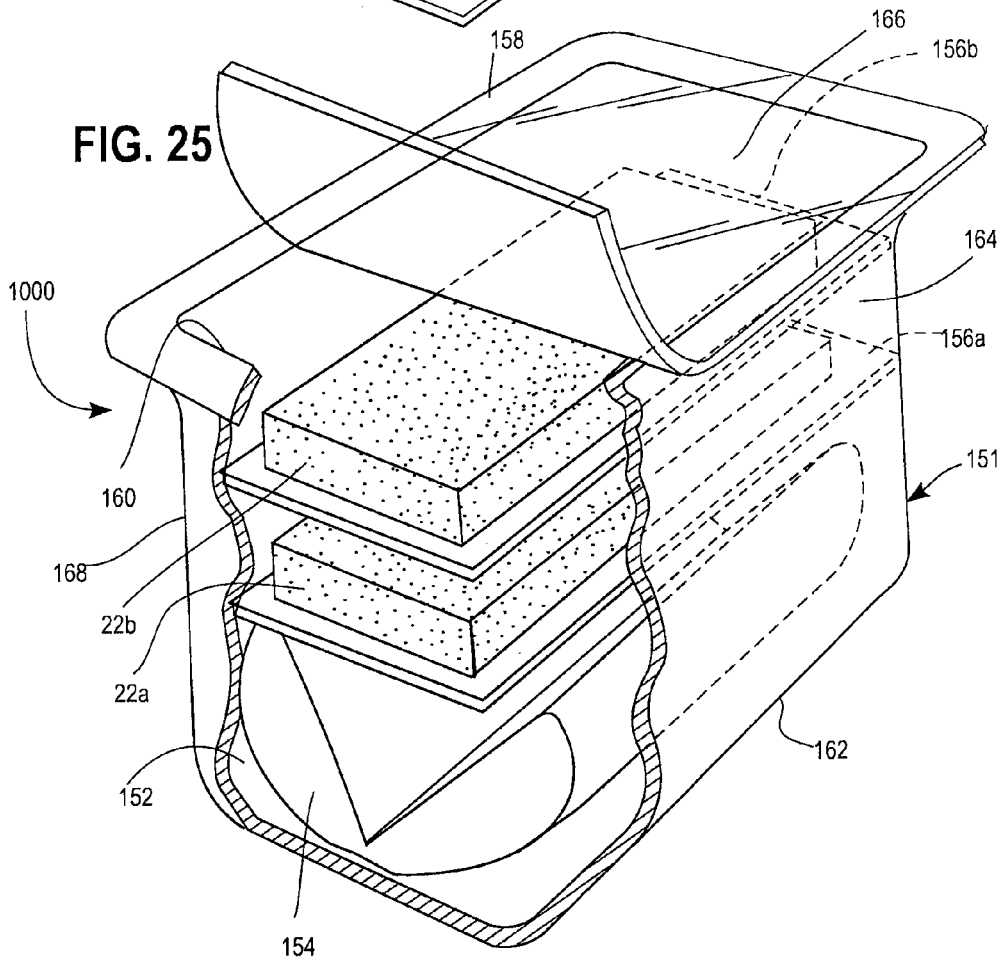
FIG. 25 is a perspective view of a fifth embodiment of a food package for segregating inner sandwich components of a sandwich.

FIGS. 18-19 show a second embodiment of the food package where the pull tab is attached to a roller that assists in removing the envelope layers. FIGS. 20-21 show a third embodiment of the food package where the pull tab is wound about a knob, such that the turning of the knob initiates the peeling of the envelope layers. FIGS. 22-23 show a fourth embodiment of the food package where the food package has a secondary compartment for retaining the ruptured envelope layers. FIG. 24 depicts a process line for manufacturing multiple envelopes and enclosing multiple sandwich components in a continuous fashion. FIG. 25 depicts a fifth embodiment of a food package where the food package comprises a single compartment container that is separated into additional compartments by a barrier layer of film. FIGS. 26A-C and 27A-B depict a sixth embodiment of a food package where the food package comprises multiple compartments separated by film dividers and assembled by folding. The barrier layer of film supports the sandwich component thereon above the bread component, separating the sandwich component and bread component, and the barrier layer can further be configured to rupture upon heating such that the sandwich component can then be combined with the bread component.

Figures 1, 2, 3:
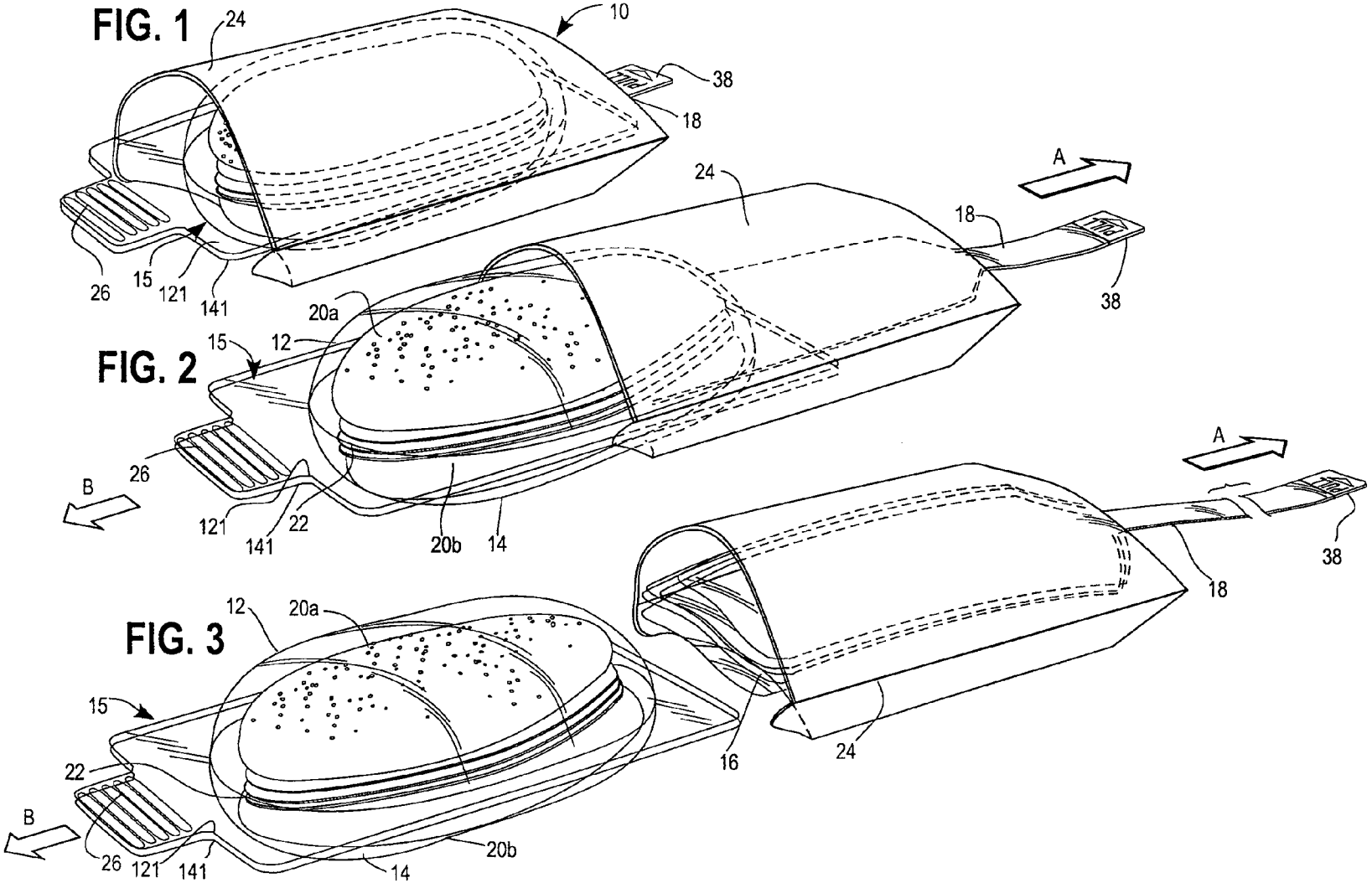
FIG. 1 is a perspective view of a food package for segregating inner sandwich components of a sandwich within envelopes that are in an unopened state.
FIG. 2 is a perspective view of the food package of FIG. 1 where the packaged sandwich components are in a partially open state.
FIG. 3 is a perspective view of the food package of FIG. 1 where the packaged sandwich components are in an open state.

Turning to FIGS. 1-3, a package 10 for segregating food components 22 of a sandwich 20 is shown having a sleeve 24, a generally rigid outer container 15 and at least one generally flexible envelope 16 therein, and as shown in these figures, at least two generally flexible envelopes 16 therein. The sandwich 20 can comprise a pair of bread components 20*a* and 20*b* having at least one sandwich component 22 substantially enclosed in the envelope 16 and between the bread components 20*a* and 20*b*, where the sandwich component 22 can comprise any topping, garnish or filling that is typically found in a sandwich. The rigid outer container 15 can have a top compartment 12 for receiving one of the pair of bread components 20*a* and a bottom compartment 14 for receiving the other of the pair of bread components 20*b*. Alternatively, where the sandwich only has one bread component, such as with a pizza or flatbread sandwich, the outer container can have a compartment for receiving the one bread component therein. The term "rigid" is used herein to indicate that the compartments 12 and 14 have the ability to retain their respective shapes during normal handling, and preferably, can comprise a rigid plastic material. The term "flexible" is used herein to indicate a pliable and workable material, such as a polymer material. The term "sandwich" is used herein to indicate any assembled multi-component food product such as a sandwich, a flatbread sandwich (i.e., a one-bread sandwich), a burger, a wrap, a pizza, and the like, in which a farinaceous outer food component encloses or contains an inner food component, where the inner food component can include a food used as a topping. The term "bread component" is used herein to indicate any farinaceous food component. Alternatively, a non-food component may also be packaged in such a container where it is desirable to separate the components from each other.

In FIGS. 1 and 4, the package 10 is depicted during storage of the sandwich 20 prior to opening. The sandwich can comprise a bun crown or upper bread component 20*a* placed in the top compartment 12 of the rigid outer container 15 and a bun heel or lower bread component 20*b* placed in the bottom compartment 14. As shown in the figures herein, there are at least two sandwich components 22 between the pair of bread components 20*a* and 20*b*, such as a meat and cheese component, or any other desired sandwich garnishment; alternatively, there can be more or less sandwich components.

The flexible envelope 16 is positioned between the pair of bread components 20*a* and 20*b* and can completely enclose or partially enclose at least one sandwich component 22 effectively providing a barrier layer between the inner components. Preferably, a single flexible envelope 16 is used per single sandwich component 22. Therefore, if there are multiple sandwich components 22 then there will equally be a multiple number of flexible envelopes 16, one for each component 22. Alternatively, it may also be possible for a single flexible envelope 16 to enclose multiple sandwich components 22 where the sandwich components are the same or where moisture migration is not an issue, and several such combination envelopes can be provided or may be combined within the sandwich together with one or more single-component envelopes.

The flexible envelope 16 may be any shape and size such that it adequately conforms to the shape of the sandwich component 22, and/or conforms to the shape of the bread components 20*a* and 20*b*, and adequately encloses the sandwich component 22. The envelope 16 can be rectangular and sized as long and as wide as the bread components 20*a* and 20*b*. Preferably, the envelope 16 will have a point or taper at one end to which a pull tab film layer can be integral or adhered to, as will be discussed herein. The flexible envelope 16 may be sealed, or closed, on all four sides or peripheral edge portions 30 of the envelope 16, as shown in FIG. 9, such that it completely encloses the sandwich component 22. In the envelope 16 shown in FIGS. 9-10, one side portion or peripheral edge portion 30 can be folded while the remaining sides can be sealed at their respective peripheral edge portions 30 by a rupturable seal 28. Alternatively, the envelope 16 can be sealed on all four edge portions 30, or can be sealed on at least one edge portion 30 but less than all side edge portions 30.

The rupturable seal 28 is formed along the edge portions 30 such that upon applying a force to the envelope 16, the seals 28 separate or peel apart, effectively pulling the layers of the envelope 16 apart initially at the point or edge 31 furthest from the pull force such that the layers 16*a* and 16*b* begin to peel and roll back onto themselves, exposing the sandwich component 22 to the rest of the sandwich 20, as shown in FIG. 10. As the pull tab 18 is pulled in the direction of arrows A, the upper layer 16*a* and lower layer 16*b* begin to separate along the trailing edge 31 at its rupturable seal 28 thereat. Although the free end of the pull tab 18 is located adjacent the leading edge 32, as the pull tab 18 is pulled it begins to separate the layers at the trailing edge 31 first rather than at the leading edge 32, as depicted by arrows C. A peeling rather than a sliding motion may take place upon opening the envelope 16, i.e., rupturing the seals 28, or a combination of a peeling and a sliding motion, which can reduce the forces needed for removal of the layers to a practical level as compared to solely sliding the envelope layers apart from one another. It is believed that the peeling action imparts a force across a line rather than an area, and the separation of the layers is accomplished by tensile failure of the adhesive bond between the sandwich components 22 (i.e., cheese, meat, etc.) and the packaging film.

The rupturable seal 28 can be strong enough such that the edges of the envelope 16 remain sealed while the sandwich is unopened yet the seals 28 peel apart upon applying a force to the envelope when pulling on a protruding end portion 18, or pull tab feature. A protruding end portion 18 can be positioned at any edge portion 30 of the envelope 16, such that it is anchored and affixed to one end 31 of the envelope 16 while its end can extend across the envelope 16 to extend past an opposite edge 32 of the envelope 16 from the anchor point to provide the pull tab end 18 for pulling. The end 31 of the envelope 16 to which the pull tab 18 is affixed can become the initiating point for the peel or where the seals initially peel. The protruding edge portion 18, or tab that extends beyond the edge of the envelope 16, can be pulled to apply the force needed to peel apart the envelopes 16 and peel the respective layers apart in a "rolling" peel motion. Furthermore, the protruding end portion 18 may be made up of multiple layers that can combine to form a common pull tab, or protruding end portion 18.

The flexible envelope 16 substantially completely encloses the sandwich component 22, such that it envelops the sandwich component 22 on substantially all sides, as shown in FIGS. 9-12. The flexible envelope 16 can have an upper layer 16*a* and a lower layer 16*b* that are sealed to each other along their respective peripheral edge portions 30 by a rupturable seal 28, e.g., a heat seal, or have at least one folded edge thereat. The flexible envelope 16 may comprise a single sheet, or single layer, folded to create an upper layer 16*a* and a lower layer 16*b*, such that the single sheet can be sealed to itself along at least one edge portion 30 of the upper layer 16*a* and lower layer 16*b*, and preferably along all edge portions 30 except the folded edge portion 32. Alternatively, the flexible envelope 16 may comprise two individual sheets or layers that are sealed to each other along substantially all peripheral edge portions 30, and does not contain a folded edge portion.

In another aspect of the envelope, an upper and lower film layer 16*a*' and 16*b*' can be provided with a cutout area 34 in both layers, as shown in FIGS. 11-12. The cutout area 34 allows for extracting the sandwich component 22 therein from the envelope 16' by pulling upon a pull strip 64 to remove the envelope 16' from around the sandwich component 22. The opening 34 can be formed a number of different ways such as utilizing two separate layers or sheets and leaving one edge portion 30 substantially unsealed, or by providing a single sheet that is folded and either the folded edge 32 has a portion cut out of it to create an opening 34 or the opposite edge from the fold is not sealed, or any other similar embodiment. Additionally, an upper flap 36*a* and lower flap 36*b* can be attached over the cutout area 34, as shown in FIG. 11, and can further comprise narrow peelable seal areas along where the flaps 36*a* and 36*b* intersect the envelope layers 16*a*' and 16*b*'. A protruding end portion 18', or pull tab, can be affixed to a portion of the flaps 36*a* and 36*b* or can be an extension of the flap 36, such that a protruding end portion 18 can extend from each flap 36*a* and 36*b*, allowing the flaps 36*a* and 36*b* to be peeled off of the envelope 16' using a rolling peel action, when the pull tabs 18*a*' and 18*b*' are pulled.

Substantially simultaneously to the pulling of the pull tabs 18*a* and 18*b* to remove the flaps 36*a* and 36*b*, the opposite end 31 of the envelope 16' can also be pulled. Preferably, the opposite trailing end 31 can also have a protruding strip 64 for grasping or a pull strip 64. As both ends are pulled, relatively simultaneously, the upper and lower flaps 36*a* and 36*b* can roll and slide upon themselves to peel off to expose the cutout area 34 and the sandwich component 22 therein, while the pull strip 64 is also pulled to remove the remaining envelope layers 16' from around the sandwich component 22, which is extracted through the opening 34 relatively simultaneously. Where there are multiple sandwich components 22, there can also be multiple envelopes 16' used. When multiple envelopes 16' are included, the pull tabs 18' from each flap 36 can all be grouped together on one side; likewise the pull strips 64 from the opposite end 31 of each envelope 16' can also all be grouped together on one-side to be grasped and pulled relatively simultaneously. In yet another aspect, the protruding end portions 18' may be of varying lengths to initiate a substantially sequential peel action, which can minimize the peel force. Once the flaps 36 are removed from the envelope 16', the envelope 16' can be withdrawn from around the sandwich component 22 and the sandwich component 22 can be removed through the opening 34.

The protruding end portion 18 can be an extension of the flexible envelope 16, such as an extension of one of the sheets 16*a* or 16*b* of the envelope 16, or it can be a separate piece that can be affixed to an edge portion 30 of the envelope 16. The protruding end portion 18 can further comprise a single layer attached to the end portion 30 of the envelope 16 or it can comprise an extension of the multiple layers of the envelopes 16 sealed together to form a single unit, or any other similar variation of a single or multiple layered end portion 18. When there are multiple envelopes 16 placed in between the sandwich components 22, each of the multiple envelopes 16 can be connected to a single common protruding end portion 18, thus applying a pulling force to the protruding end portion 18 applies a force to all of the envelope seals 28, peeling apart the envelopes 16 substantially simultaneously.

In one aspect, a separate layer of film 62 that can extend into the protruding end portion 18 can be attached to at least a layer of the envelope 16*a* or 16*b*, such that a first pull tab film layer 62*a* can be attached to the upper layer 16*a* and a second pull tab film layer 62*b* can be attached to a lower layer 16*b*. Alternatively, as shown in FIGS. 7 and 8, the pull tab film layers 62*a* and 62*b* can be extensions of their respective envelope layer. For example, each envelope 16 that comprises an upper 16*a* and a lower layer 16*b* can also have two pull tab film layers 62*a* and 62*b*, a first layer 62*a* and a second layer 62*b*, where the first pull tab film layer 62*a* is an extension of the film of the upper layer 16*a* and the second pull tab film layer 62*b* is an extension of the film of the lower layer 16*b*, thus the pull tab film layers 62*a* and 62*b* can loop back across their respective envelope layer 16*a* or 16*b* at the trailing edge of the envelope 16. The free end of the pull tab film layers 62*a* and 62*b* can protrude out from the sandwich 20 and container 15, and form a part of the protruding end portion 18, where the protruding end portion 18 can essentially be made up of multiple film layers that extend into the pull tab 18. Furthermore, it is preferable that the first pull tab film layer 62*a* and second pull tab film layer 62*b* originate at least at the trailing end 31 of the envelope 16 that is farthest, e.g., opposite, from the protruding end portion 18, such that when the protruding end portion 18 is grasped and pulled the rupturable seal 28 of the envelope 16 begins to separate and break at the trailing end 31 opposite the protruding end portion 18, where the pull tab film layers 62*a* and 62*b* are affixed to the envelope layer, or originate therefrom. This can create a rolling peel motion, where the envelope 16 is separated along its seals 28 in a sequential motion starting at the farthest end 31 of the envelope 16 (e.g., where the first pull tab layer 62*a* and second pull tab layer 62*b* of the protruding end 18 are attached or originate from) and continuing along its side edges 30 to its end 32 closest to the protruding end portion 18.

In another aspect, the end 31 of the envelope 16 furthest from the protruding end portion 18 can be tapered or pointed, as shown in FIG. 9, such that the area of rupture or peeling for that seal has a small surface area. This aspect allows for a smaller area of resistance when pulling, thus the seal at the tapered end 31 can peel apart with less force. It is preferable that the seal area at the farthest edge 31 is not wider than the width of the pull tab layer of film of the protruding end 18, to allow for an easier initial peeling of the envelope 16. This method of a rolling peel essentially rolls the envelope layers 16*a* and 16*b* away from the sandwich component 22 inside, rolling the layers of film 16*a* and 16*b* back upon itself. That is, the layers 16*a* and 16*b* are not being pulled out as much as they are being "rolled" away, such that the layers 16*a* and 16*b* are not sliding over the sandwich component 22.

When the envelope 16 is placed in the sandwich 20 between the bread components 20*a* and 20*b*, the protruding end portion 18 can extend outwardly from between the bread components 20*a* and 20*b* such that the protruding end portion 18 is external to the sandwich 20. As the sandwich 20 is placed in the rigid container 15, where the upper bread component 20*a* is contained in the top compartment 12 and the lower bread component 20*b* is contained in the bottom compartment 14, and the top and bottom compartments 12 and 14 are assembled in a closed configuration around the sandwich 20, the protruding end portion 18 can further extend through an opening in the rigid outer container 15 generally positioned between the top compartment 12 and the bottom compartment 14. The protruding end portion 18 can be grasped and pulled in an effort to apply a force to the flexible envelopes 16 to separate the envelopes 16 along their rupturable seals 28 about a peripheral edge portion 30 of the envelopes 16. Where the flexible envelope 16 is sealed on substantially all sides of the envelope 16 along its peripheral edge portion 30, it peels along substantially all peripheral edge portions 30. Where the envelope 16 is of the embodiment shown in FIGS. 11 and 12, upon opening the envelope 16' the sandwich component 22 can pass through the opening created by the cutout area 34 upon relatively simultaneously pulling the protruding end portion 18' and the pull strip 64 extending from the opposite side 31, thus extracting the envelope 16' from the sandwich 20, rather than requiring separation of the envelope 16' rupturable layers; although the envelope 16' can also peel along its seals 28.

Furthermore, as the envelope 16 peels apart and separates into its layers, e.g., its upper layer 16*a* and lower layer 16*b*, these ruptured layers 16*a* and 16*b* can be extracted from between the bread components 20*a* and 20*b*, and can further be extracted through the opening between the top compartment 12 and the bottom compartment 14 through which a portion of the protruding end portion 18 already extends. As the ruptured layers 16*a* and 16*b* are separated and removed from around their respective sandwich component 22, the sandwich component 22 therein remains inside the sandwich 20 between the bread components 20*a* and 20*b*, due to the force of gravity acting upon it. As the ruptured layers 16*a* and 16*b* are rolled away from the sandwich component 22, the sandwich component 22 "drops" into place between the adjacent bread component(s) 20*a* and 20*b* and/or adjacent sandwich component 22. Due to the rolling and peeling action of the ruptured layers 16*a* and 16*b*, sticking of the layers 16*a* and 16*b* to the sandwich component 22 and pulling on the sandwich component 22 can be minimized. This can advantageously reduce buckling or bulging of the sandwich component 22 during removal of the envelope 16, as well as sliding, but rather can remain positioned essentially between the two bread components 20*a* and 20*b*.

In yet another aspect, as shown in FIGS. 7 and 8, an additional film layer 60 can be positioned adjacent the envelopes 16 to enclose one or both of the bread components 20*a* and 20*b* in their respective compartment 12 or 14. For instance, a compartment film layer 60*a*, or a bread film layer 60*a*, that encloses the top bread component 20*a* within the top compartment 12 can extend across the opening of the top compartment 12 and can be sealed to the outer flanges 121 of the top compartment 12. In order for the bread film layer 60 to be removed by peeling the seals between the film layer 60 and the outer flanges 121 or 141, a protruding end portion film layer or pull tab film layer 62*c* can also be attached. In this aspect, the pull tab film layer 62*c* can be an extension of the bread film layer 60, such that it loops back across the bread film layer 60 at an end opposite the protruding end portion 18 or pull tab, i.e., the trailing end. This arrangement of the pull tab film layer 62*c* similarly provides for a rolling peel action of the bread film layer 60 upon opening, i.e., upon applying a force to the protruding end portion pull tab 18, such that the bread film layer 60 rolls or peels away from the bread 20*a* or 20*b* leaving the bread 20*a* or 20*b* and adjacent components 22 relatively undisturbed. Alternatively, the pull tab film layer 62*c* can be a separate layer attached to the trailing end of the bread film layer 60. A bread film layer 60*b* can similarly be provided to the opposite bread component 20*b* and opposite compartment 14, such that both bread components 20*a* and 20*b* can be sealed within their respective compartments 12 and 14.

In still another aspect where at least one envelope 16 is provided, one of the layers 16*a* or 16*b* of the envelope 16 can be attached to the flange 121 or 141 of one of the compartments 12 or 14 as shown in FIG. 7. In one aspect, at least two envelopes 16 can be provided, where one of the envelopes 16 can be attached to the flange 121 of the top compartment 12, just beyond the film 60 that seals to the flange 121 for enclosing the bread 20*a*, by heat-sealing on the leading edge and sides of that envelope 16. Additionally, the other envelope 16 can be attached to the bottom compartment 14 in a similar manner. One of the two layers 16*a* and 16*b* of the envelope can extend beyond the perimeter of the other and this longer envelope layer can seal to the flange 121 or 141 of the compartment 12 or 14 while the other layer seals to the longer layer. For example, where the upper layer 16*a* is adjacent the top compartment 12 and the lower layer 16*b* is adjacent the inside of the sandwich 20, or the bottom compartment 14, the lower layer 16*b* can extend beyond the edges of the upper layer 16*a* and can seal to the flange 121 of the top compartment 12 just beyond the sealed edges of the bread film layer 60, if used. The upper layer 16*a* would then seal along its edges to the lower layer 16*b* but within the perimeter of the top compartment 12. Similarly, a layer of the second envelope 16 can be sealed to the flange 141 of the bottom compartment 14, i.e., the upper layer 16*a* of the second envelope 16 would be sealed to the flange 141, with the lower layer 16*b* of the second envelope 16 being sealed to the upper layer 16*a*.

The attachment of the envelopes 16 can be in such a way that the envelopes 16 can be peeled open using a pull tab 18 that also relatively simultaneously or relatively sequentially peels the bread film layer 60 from its compartment 12 or 14 to expose the bread 20*a* and 20*b*. The envelopes 16 can also be peeled away from the flanges 121 or 141 of the compartments 12 and 14 using the pull tabs 18, however, the peeling of the film layer from the flanges 121 or 141 can lag the other layers slightly. For example, each envelope 16 or bread film layer 60 can have its own pull tab film layer 62 which can be attached to its respective film, or an extension thereof at least at one end, thus extending across the envelope 16 or bread film layer 60 to the opposite end to a common protruding tab 18, formed of the multiple film layers 62. The lower layer 16*b*, which is sealed to the flange 121 can have a pull tab film layer 62*b* affixed to the lower layer 16*b* or an extension of the lower layer 16*b* as shown in FIG. 7, at least at one end, such as the trailing end, and can extend between the lower layer 16*b* and the second envelope, if present. Similarly, the bread film layer 60 can also have a pull tab film layer 62*c* extending from the bread film layer 60 at its trailing end and extending across the bread film layer 60, between the pull tab film layer 62*a* of the upper layer 16*a* and the bread film layer 60. The upper layer 16*a* can have a pull tab film layer 62*a* as in previous embodiments.

The pull tab film layers 62*a*-62*c* can be grouped together on the same side, opposite their attachment point, and can be combined into a common protruding end tab 18. The lengths of the pull tab film layers 62*a*-62*c* and their position are such that the initiation of peeling each layer can be slightly staggered. For example, where the lower layer 16*b* is attached to the flange 121, upon pulling the pull tab 18 the upper layer 16*a* and the bread film layer 60 can begin to peel relatively simultaneously while the lower layer 16*b* can begin to peel last. This is so the upper layer 16*a* has a surface against which it can be pulled, in this instance it is the lower layer 16*b*. Therefore, the lower layer 16*b* can remain intact at least initially to allow the upper layer 16*a* to begin separating from the lower layer 16*b*. Likewise, it can be desirable to also begin peeling away the bread film layer 60 before the last envelope layer, in this case the lower layer 16*b*, so that the sandwich component 22 inside the envelope 16 does not catch or get stuck to the bread film layer 60, such that it would peel away with the bread film layer 60. Additionally, a portion of the lower layer 16*b* may not be sealed completely to the flange 121 at the leading edge, (i.e., edge near protruding ends 18)

such that the pull tab film layers 62*a* and 62*c* of the upper layer 16*a* and bread film layer 60, respectively can pass through an opening in the film layers, such as between the lower layer 16*b* and the bread film layer 60, to allow the pull tab film layers 62*a* and 62*c* to extend into the common pull tab 18, as seen in FIG. 8.

Delaying the peeling of the envelope films from its respective compartment flange 121 or 141 can allow the envelopes 16 to be peeled open without the need of support frames, thus simplifying the design and reducing packaging material. The pull tab 18 can comprise multiple layers of pull tabs from each layer of film that can be bonded together at their ends to form one common pull tab 18 to allow opening all component compartments and envelopes 16 substantially simultaneously or such that the initial peel can be slightly staggered with a simple, single pulling action. Since the film layers are peeled using a rolling action, all the food components 22 can remain relatively undisturbed from their original position, thus resulting in a neatly stacked assembly within the container 15.

Figure 17A:
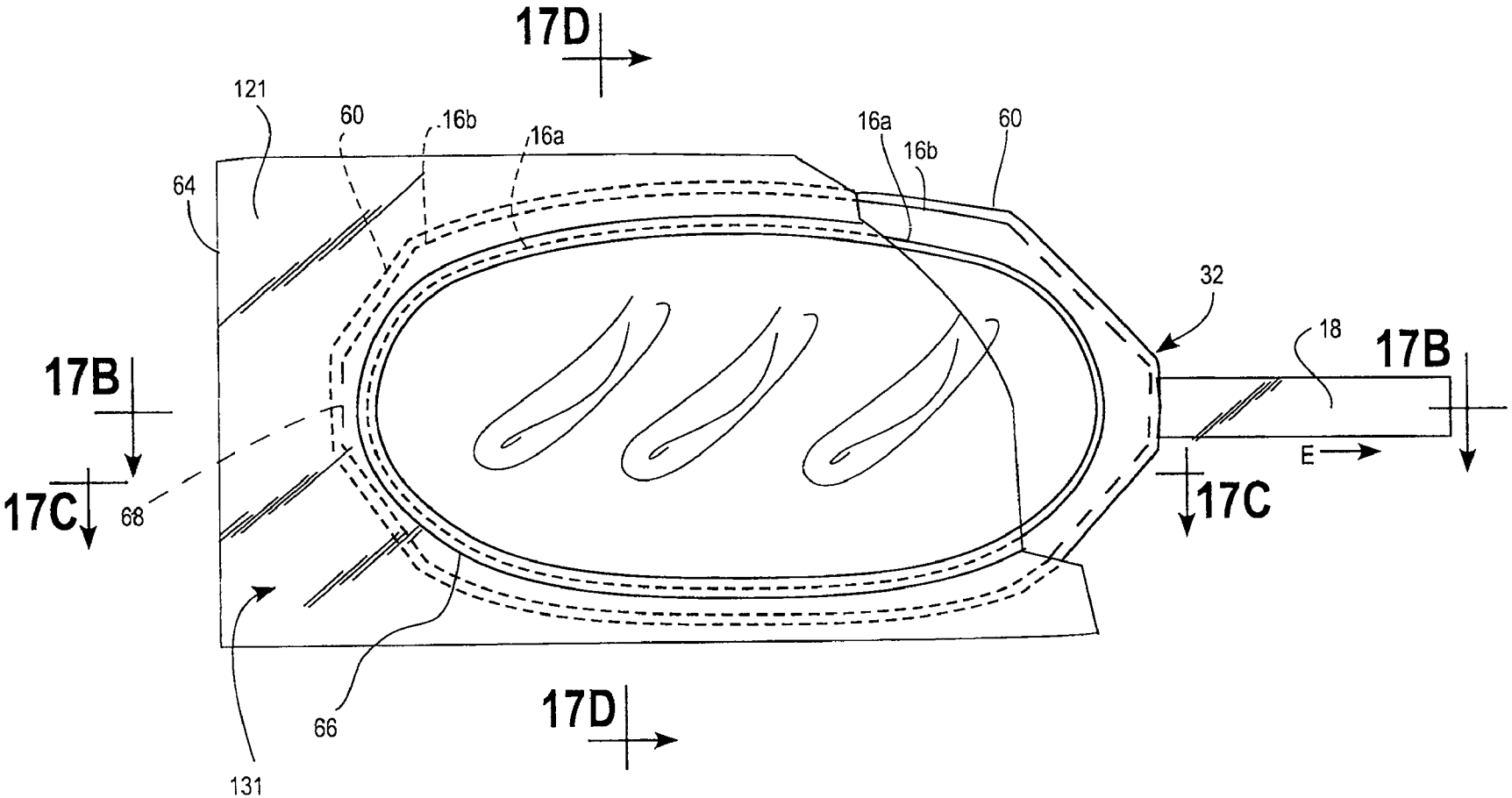
FIG. 17A is a top plan view of a food package including a fifth embodiment of an envelope for enclosing a sandwich component.

In yet another aspect, the envelope 16 can be sealed to the bread film layer 60 itself, or rather at least one of the envelope layers 16*a* or 16*b* can be sealed to a portion of the bread film layer 60, as shown in FIGS. 17A-D. For example, an envelope 16 having its upper layer 16*a* adjacent the bread film layer 60, can be sealed to the lower layer 16*b* along its edges to form the envelope 16 with rupturable seals 28 therebetween, as in previous embodiments. However, the lower layer 16*b* can then be sealed to a portion of the bread film layer 60 at least along a portion of its edges thereof, as shown in FIG. 17A. All layers 16*a*, 16*b* and 60 can have a common protruding end portion 18 or pull tab formed from multiple pull tab film layers 62*a*-62*c*, respectively, that originate from a trailing edge 131 that is opposite the pull direction E, however, each envelope film layer 16*a* or 16*b* or bread layer 60 in this aspect can peel at different times. This is because of the way the pull tab film layers 62*a*-62*c* are positioned, such that pulling on their common pull tab 18 will begin a sequential peel.

As shown in FIG. 17A, the bread film layer 60 is sealed to the flange 121 of the rigid container 15. In this aspect, the top compartment 12 is illustrated, however, a similar arrangement can be shown with the bottom compartment 14 and its bottom flange 141. The flange 121 is defined as the area between the outer edge 64 of the container 15 and the intersection of an upper extension of the top compartment 12 with the beginning of a horizontal section of the container 15, as designated by a circular edge 66.

Figure 17B:
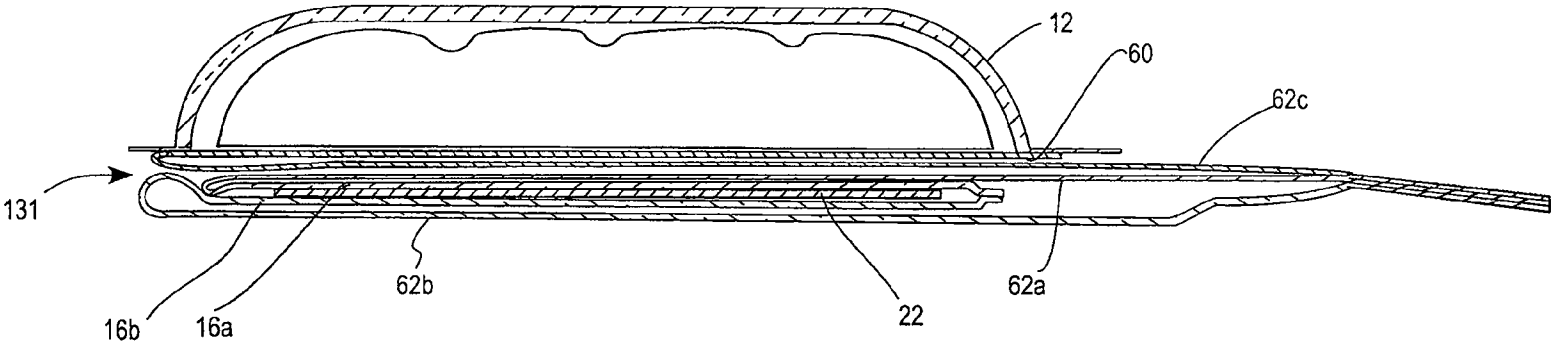
FIG. 17B is a cross-sectional view of the fifth embodiment of the envelope of FIG. 17A taken along the line 17B-17B, and showing only the top half of the food package.
Figure 17C:
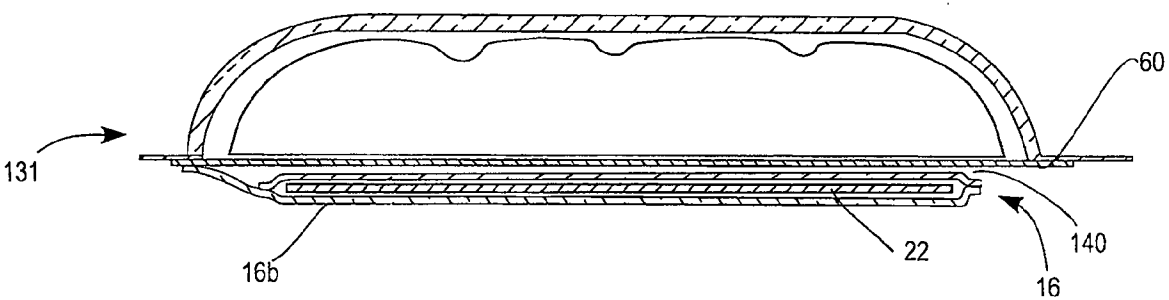
FIG. 17C is a cross-sectional view of the fifth embodiment of the envelope of FIG. 17A taken along the line 17C-17C, and showing only the top half of the food package.
Figure 17D:
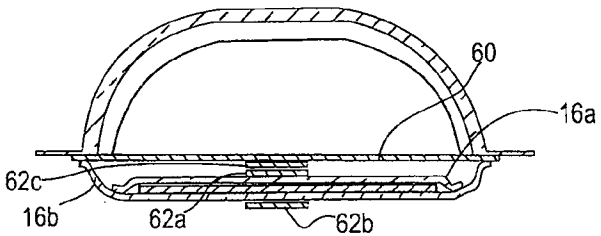
FIG. 17D is a cross-sectional view of the fifth embodiment of the envelope of FIG. 17A taken along the line 17D-17D, and showing only the top half of the food package.

The lower layer 16*b* is sealed to the bread film layer 60 at a peripheral edge of the bread film layer 60 such that a peripheral edge of the lower layer 16*b* extends into the area of the flange 121, just beyond the circular edge 66. Furthermore, the lower layer 16*b* may not be completely sealed to the bread film layer 60 about its perimeter. For instance, as illustrated in FIG. 17B, the lower layer 16*b* can contain portions along its perimeter that are unsealed to the bread film layer 60. In one aspect, a section of an edge 68 of the lower layer 16*b* that is adjacent the pull tab film layer 62*c* of the bread film layer 60 can remain unsealed to the bread film layer 60 to allow the pull tab film layer 62*c* to loop away from the bread film layer 60 and extend between the bread film layer 60 and the upper layer 16*a* of the envelope 16 through an opening created by the unsealed area 68. The unsealed section 68 can be as wide as the pull tab film layer 62*c* such that the pull tab film layer 62*c* can loop through the opening created by the unsealed area 68, as shown in FIG. 17B, however, the unsealed area 68 may also be wider. In another aspect, the lower layer 16*b* can also remain unsealed to the bread film layer 60 at the leading edge 32 of the container 15, to allow for the pull tab film layers 62*a* and 62*c* to extend into the space 140 between the lower layer 16*b* and the bread film layer 60 and past the leading edge 32 and into the common pull tab 18. The remaining perimeter edge portion of the lower layer 16*b* can be sealed to the periphery of the bread film layer 60, as shown in FIGS. 17C and 17D, including a portion of the perimeter of the lower layer 16*b* at the trailing end 131 that is not immediately adjacent the pull tab film layer 62*c*. FIGS. 17A-D illustrate only the top half (i.e., top compartment 12) of the food package, however a similar arrangement can also be provided on the bottom half (i.e., bottom compartment 14) of the food package.

The sequential peel of the film layers 16*a*, 16*b* and 60 can be initiated by pulling on the common pull tab 18 which can begin peeling the film layers 16*a*, 16*b* and 60 at different times. For example, in the aspect shown in FIGS. 17A-D, the first seal to peel and to begin the rolling peel process can be the upper layer 16*a*. The upper layer 16*a* can begin to peel first, such that it can use the lower layer 16*b* to peel against and away from. This is followed by the lower layer 16*b* beginning to peel after the upper layer 16*a* has started to peel. Similarly, this layer 16*b* can use the bread film layer 60 as an anchor against which to begin peeling. Lastly the bread film layer 60 can peel away from the flange 121. The bread film layer 60 can also use the flange 121 as an anchor against which it can peel away from.

The pull tab film layers 62*a*-62*c* can each be attached to their respective layer 16*a*, 16*b* or 60, as previously discussed, either as a separate film layer or as an extension of the envelope 16 or bread layer 60 that loops away from and across its layer. The pull tab film layers 62*a*, 62*b* and 62*c* can all loop back away from their respective layers and extend adjacent and across their respective layers 16*a*, 16*b* and 60 and into the common pull tab 18. Therefore, in one aspect, the pull tab film layer 62*c* of the bread film layer 60 can also loop away from its respective layer 60 to extend adjacent and across the bread film layer 60, and further extending between the upper layer 16*a* and the bread film layer 60 to exit at the leading edge 32 and into the common pull tab 18. Likewise, the pull tab film layer 62*a* can also loop away from its respective layer 16*a* to extend adjacent and across the upper layer 16*a*, extending between the upper layer 16*a* and the bread film layer 60 to exit at the leading edge 32 of the package and into the common pull tab 18. Similarly, the pull tab film layer 62*b* of the lower layer 16*b* can also loop away from its respective layer 16*b* to extend adjacent to and across the lower layer 16*b* and into the common pull tab 18.

In still another aspect, a pull tab 181 can be built into an outer surface of one of the envelope layers 1116*a* or 1116*b*, as shown in FIGS. 15 and 16, such that substantially one contiguous piece can be manufactured having a stub portion 66 extending past one edge 32 of the envelope 1116. This stub portion 66 can be a short pull tab or can be a long protruding pull tab. The outline of the pull tab 181 can be pre-cut into an upper surface of one of the layers 1116*a* or 1116*b* of the envelope 1116, such as by pre-scoring the pull tab 181 into the outer surface of the envelope layer 1116*a* or 1116*b* with the stub portion 66 at the end of it. For example, the outer surface of the upper layer 1116*a* can be pre-scored with the shape of the pull tab 181, having the stub portion 66 extend past the edge 32 of the envelope 1116 at one end of the pull tab 181. The outer surface of the upper layer 1116*a*, or lower layer 1116*b*, can be laminated onto another single layer or another multiple layered film, such that the layer of film with the pre-scored pull tab 181 can be adhered to the single or multi-layered film using a permanent adhesive along its back surface in all areas except for where the pre-scored pull tab 181 is located.

The stub portion 66 can comprise an extension of the layer of film 1116*a* with the pre-scored pull tab 181 adhered to the single or multi-layered film, and further can also be adhered to the additional layer or layers of film via a permanent adhesive so that when it is pulled it stays together. For example, where the pre-scored pull tab 181 is on the upper layer 1116*a*, then the upper layer 1116*a* can be adhered with the permanent adhesive along its back surface to another layer, except where the pre-scored pull tab 181 is located, to collectively make up the final upper layer 1116*a;* the lower layer 1116*b* may or may not also comprise a multi-layer with a pre-scored pull tab 181. Therefore, when the stub portion 66 is grasped and pulled it peels together all the way to point "X", which is slightly before the edge 32 of the envelope 1116, at which point only the top layer of film without permanent adhesive, e.g., the pre-scored pull tab 181, continues to tear off the upper layer 1116*a*, until it reaches the trailing edge 31, where it remains attached, thus forming a longer pull tab portion for pulling apart the envelope 1116 at its rupturable seals 28. Alternatively, the stub portion 66 can be combined with a common pull tab 18 such that the pull tab 18 is pulled to remove the pre-scored pull tab 181 from its respective film layer as well as peel apart the seals 28 between the envelope layers. Utilizing the pull tab 18 in this manner can be effective since it is believed that the pre-scored pull tab 181 is held in place against its respective film layer by static energy rather than a strong physical bond. If the other layer, e.g., the lower layer 1116*b* in this aspect, does not contain a pre-scored pull tab 181, then it would be advantageous for it to at least comprise a pull tab film layer 62 as previously discussed.

In order to activate the opening of the envelope 1116 by peeling its seals 28, the pre-scored pull tab 181 needs to be separated from the upper layer 1116*a* first, as shown in FIG. 16. To remove the pull tab 181 from the upper layer 1116*a*, its stub portion 66 can be grasped or its pull tab 18 attached to the stub portion 66 pulled. Once the stub portion 66 or pull tab 18 is pulled to where it intersects the edge 32 of the envelope 1116, e.g., at point X, the pre-scored pull tab 181 can begin to tear and to remove the pull tab 181 from the upper layer 1116*a*, since the pre-scored pull tab 181 does not contain any permanent adhesive along its backside. Once the pull tab 181 is pulled across the upper layer 1116*a*, it terminates at an edge 31 opposite the starting point of the stub portion 66, where the pull tab 181 remains connected to the upper layer 1116*a*. Once the pre-scored pull tab 181 is freed from its layer 1116*a*, then it can be pulled in direction of arrow A to initiate the peeling of the seals 28 of the envelope 1116 along arrows C, as depicted in FIG. 16. The pull tab layer 181 can comprise an O-polyester (OPET) layer or any other single or multilayer film. The pull tab layer can be adhered to a coextruded ethylene vinyl alcohol (EVOH)/ethylene vinyl acetate (EVA) layer or another polyester layer laminated to a coextruded EVOH/EVA, or any other coextruded or laminated plastic. Alternatively, the lower layer 1116*b* can include the pre-scored pull tab 181 of the envelope 1116, or still alternatively, both the upper layer 1116*a* and the lower layer 1116*b* can include the pre-scored pull tab 181.

In another aspect of the envelope 16, where a large number of envelopes need to be manufactured it may be easier to manufacture multiple, connected envelopes 16, rather than individual envelopes 16, as shown in FIG. 24. For example, a common web of film can be used for the lower layer 166*b* that can receive thereon multiple sandwich components 22 that are then sealed with multiple, narrow upper layers 16*a* while being advanced in a machine direction, M. For instance, the narrow upper layer 16*a* can be only as wide as the food or other components 22 that are to be stored therein plus the width of the rupturable seals 28. The lower layer 166*b* can be wide enough to seal a desired number of upper layers 16*a* thereto, thus where, for example, it is desired to manufacture three envelopes 16 at a time, at least three adjacent rows of upper layer films 16*a* can be required, which can be supported by the lower layer 166*b*. The upper layers 16*a* can be sealed to the lower layer 166*b* along rupturable seals 28 and can then be cut out, or separated, to form a single envelope 16 enclosing the sandwich component 22. When the multiple envelopes 16 are cut or separated they can be cut such that the lower layer 166*b* is larger or wider than the upper layer 16*a*, at least along side edges thereof. For example, the lower layer 166*b* can be cut around the sealed upper layer 16*a* such that the lower layer 166*b* extends beyond the perimeter of the side edges of the upper layer 16*a*. This is so that the larger lower layer 166*b* can be sealed to the bread film layer 60 when placed in the sandwich 20 and container 15, or alternatively can be sealed to the flanges of the container 15. Protruding end portion layers 18 similar to earlier aspects can be employed for opening the envelopes 16. For instance, the sealed envelopes 16 can have a pull tab film layer 62 attached to both the upper layer 16*a* and lower layer 16*b*. Alternatively, a knob or flap can be cut into the film to later attach a pull tab film layer 62 thereto. Still alternatively, a pre-scored pull tab 181 could be incorporated.

In another similar aspect, the upper layer 166*a* (not shown) may also comprise a single common layer of film wide enough to cover all of the components 22 and to cover the lower layer 166*b*. For instance, three separate sandwich components 22 can be sealed separately using a common upper layer 166*a* as well as a common lower layer 166*b*, where the upper layer 166*a* is a strip long enough to cover and seal all sandwich components 22 into individual envelopes 16, and subsequently multiple sealed pouches or envelopes 16 can result, which can then be separated into individual envelopes 16. Alternatively, the upper layer 166*a* comprises the wide common layer of film to which multiple lower layers 16*b* seal to form multiple envelopes along the upper layer 16*a*.

In another aspect, the upper and lower layers 116*a* and 116*b* can be laminated, employing narrow seal areas, to an intermediate 70, or middle, layer to fully enclose the sandwich component 22 in a readily peelable envelope 116. This three layer envelope 116 can be referred to as a "framed" envelope, and can be seen in FIGS. 13 and 14. The intermediate layer 70 can comprise a thin and narrow edge portion, such that the film only partially extends around the perimeter of the sandwich component 22 having a hole or hollow center therein, such as a U-shape. Having the intermediate layer extend only partially around the sandwich component 22 allows for at least a portion of the sandwich component 22 to be unbound by the intermediate layer 70, thus making extraction of the sandwich component 22 easier through this open end in the intermediate layer 70. Alternatively, the intermediate layer 70 can extend all the way around the perimeter of the sandwich component 22. At least a portion of the upper and lower layers 116*a* and 116*b* thus can be sealed at their respective edges to the edges of the intermediate layer 70, thus forming an envelope 116 with the intermediate layer 70 therebetween. Where there is a break in the intermediate layer 70, the upper layer 16*a* and lower layer 16*b* can seal to each other. The upper and lower layers 116*a* and 116*b* can have pull tabs 18 (or pull tab film layers 62) that are folded over in such a way that those layers 116*a* and 116*b* can be peeled off of the intermediate layer 70, and each other where necessary, by grasping the common pull tab 18 in one hand and an intermediate pull strip 72 attached to the intermediate layer 70 in the other and pulling in opposing directions. The upper and lower layers 116*a* and 116*b* roll and slide upon themselves and can peel off to fully expose the sandwich component 22 contained therein, as the intermediate layer 70 can be slid away from around the sandwich component 22. Where multiple framed envelopes 116 are used, all pull strips 72 can be grouped together on one side, and all pull tabs 18 can be grouped together on the other side into their respective common pull tab 18 and pull strip 72. When the strips 72 and tabs 18 are pulled substantially simultaneously all the sandwich components 22 can be released and stacked neatly upon each other.

Where the container 15 is additionally packaged inside a sleeve 24, as in FIGS. 1-6, the sleeve 24 can also have a slot or opening to allow passage of a tail or end segment 38 of the protruding end portion 18. Preferably, the slot in the sleeve 24 would be sized such that only the protruding end portion 18 can pass through it, while preventing the ruptured layers 16*a* and 16*b* of the envelope 16 to also pass through. This can be due to the fact that the ruptured layers 16*a* and 16*b* of the envelope 16 are sized wider than the slot in the sleeve 24, while the protruding end portion 18 is sized narrow enough to pass through the slot. In this aspect, the sleeve 24 can retain the ruptured layers 16*a* and 16*b* inside of the sleeve 24 and relatively out of view.

In another embodiment of the package 100, as shown in FIGS. 18 and 19, the protruding end portion 118 can be provided with a tab or ring 128 at an end segment 138 thereof, that can be grasped by the consumer and pulled in order to apply a force to the protruding end portion 118 and, resultantly, to the flexible envelopes 16 attached thereto. The protruding end portion 118 can be positioned similarly to the previous embodiment, such that a portion of the protruding end portion 118 passes through an opening in the rigid container 115, or preferably between the top compartment 12 and the bottom compartment 14. The protruding end portion 118 can be a polyester film or string. However, the remaining portion of the protruding end portion 118 that is external to the rigid container 115 can be wrapped around a spool or roller 130 that can be mounted to the container 115, and an end segment 138 of the protruding end portion 118 can extend from the roller 130, unwrapped, and containing the tab 128. As the protruding end portion 118 is pulled in the direction of arrow A, the roller 130 is activated and rotated, such that the protruding end portion 118 that is wrapped around the roller 130 unwinds and extends along the package 100, as in FIG. 19.

As the protruding end portion 118 is pulled, the flexible envelopes 16 inside the sandwich are separated and peeled along their respective rupturable seals 28, thus separating into the layers 16*a* and 16*b* of the envelope 16. The flexible envelope layers 16*a* and 16*b* can then be pulled through the same opening that the protruding end portion 118 extends through and can further be pulled towards and around the roller 130, as the protruding end portion 118 is continually being pulled. The layers 16*a* and 16*b* can also be wrapped around the roller 130 after being pulled through the opening in the rigid container 115. As a result, the layers 16*a* and 16*b* of the envelopes 16 are not left loosely outside of the rigid container 115, but rather are collected neatly about the roller 130. After the ruptured envelopes 16 have been separated and removed from the sandwich 20 and container 115, the container 115 can be opened to remove the ready-to-eat sandwich 20. To open the container 115, the top compartment 12 can be separated from the bottom compartment 14 and preferably the two will be integrally connected along a portion of a side edge, such as by a hinged portion 132.

In still another alternate embodiment of the package 200, as shown in FIGS. 20 and 21, the protruding end portion 218 can be substantially completely wrapped around a rotating spool or knob 230 that is mounted to the container 215, such that it does not contain an end segment of the protruding end portion 218 that extends loosely and visibly from the knob 230, e.g., there is no pull tab arrangement. To remove the flexible envelopes 16, the consumer only needs to rotate the knob 230 axially, such that as the knob 230 rotates, it pulls on the envelopes 16 applying a force that can peel apart the seals 28 and separate the layers 16*a* and 16*b* of the envelope 16. Thus, the consumer does not need to apply a force directly to the protruding end portion 218 to separate the envelopes 16. As the envelopes 16 are separated and removed from around the sandwich component 22 and from the container 215, the remainder of the layers 16*a* and 16*b* can also be wrapped around the knob 230, thus being relatively hidden from view. Again, optionally, the rigid container 215 may contain a hinged portion 232 along one side edge of the container 215, along which the top compartment 12 and bottom compartment 14 can be attached.

In yet another alternate embodiment of the package 300, as shown in FIGS. 22 and 23, the rigid container 315 can have a secondary compartment 334 in either the top or bottom compartment 12 or 14, e.g., FIG. 23 shows a secondary compartment 334 positioned in the bottom compartment 14, which receives a portion of the protruding end portion 318 during storage and prior to use/opening the package 300. The protruding end portion 318 can extend into the secondary compartment 334 with an end segment 338 of the protruding end portion 318 extending through a slot or opening 336 in the secondary compartment 334, and where the end segment 338 can be used as a pull tab and can be grasped and pulled by the consumer. The slot 336 can be provided in the secondary compartment 334 and/or in one of the top or bottom compartment 12 or 14.

In addition, the secondary compartment 334 can also house a rotating spool or roller 330, about which a portion of the protruding end portion 318 is wrapped around. The roller 330 is activated upon pulling the end segment 338 of the protruding end portion 318, and further peels the seals 28 of the envelopes 16 as the roller 330 is continually turned. The ruptured envelope layers 16 can be rolled up along the roller 330 as they are removed from the sandwich and container 315 and pulled into the secondary compartment 334 as the protruding end portion 318 is continually pulled, and where the layers 16*a* and 16*b* can be hidden from view.

In a variation of the envelopes and food package discussed herein, another embodiment of a food package can be provided where the inner sandwich components 22 are each separated by a barrier layer of heat-shrink film, as shown in FIG. 25. The barrier layer 156 can be configured to rupture as a result of microwave heating to at least partially combine the sandwich components with each other and with a bread component to form a common food product or sandwich. Once the sandwich is ready to be consumed, the entire package 1000 can be placed into a microwave and heated such that the heat-shrink film layers 156 can shrink and at least partially retract toward the point of attachment, thus allowing for the sandwich components 22*a* and 22*b* to combine with the bread component 154 due to the force of gravity.

A first sandwich component 22*a* can be supported upon a heat-shrink film layer 156*a* that can be affixed relative to the upstanding sidewall of the container 151 such that the first sandwich component 22*a* can be positioned above the bread component 154. The heat-shrink film layer 156*a* can also separate a bottom-facing side of the sandwich component 22*a* from the bread component 154, such that each is housed in a separate compartment 152 and 164. On the opposite side of the sandwich component 22*a*, i.e., the top facing side, the sandwich component 22*a* can be enclosed by either the lid 158 or another film layer 156*b* forming a separate compartment 164 for the first sandwich component 22*a*. If a second sandwich component 22*b* is provided, then it too can have a heat-shrink film layer 156*b* positioned at a bottom-facing side of the sandwich component 22*b*, thus forming a separate compartment 166 for the second sandwich component 22*b*, where the second sandwich component 22*b* is positioned above the first sandwich component 22*a*. The layers 156 of the heat-shrink film can provide multiple compartments 164 and 166 that support the sandwich components 22*a* and 22*b* thereon and separate the sandwich components 22*a* and 22*b* from the bread component 154 until ready to be heated and combined.

The outer container 151 can comprise a main inner compartment 152 that houses the bread component 154. The bread component 154 can comprise a top bun and a bottom bun or a cylinder-shaped bread component that is cut down the middle forming two connected halves, or any other type of bread shape or orientation. The bread component 154 can be positioned such that it will receive the sandwich component 22 in an interior section of the bread 154, if it is a sandwich, or on an outer surface of the bread 154 if the final product is a pizza or flatbread type sandwich. Regardless of how the bread component 154 is shaped or positioned, the entire bread component 154 can be housed in the same compartment i.e., the main inner compartment 152. The outer container 151 can comprise a base 162 with an upstanding sidewall 168 to define an opening 160 opposite the base 162. The food package 1000 can also include a lid 158 or other type of closure that covers the opening 160. Inside of the container 151 in an interior section, the sandwich components 22 can be positioned supported on the layer of film 156 above the bread component 154.

In one aspect upon heating the container 1000, the center or middle area of the film layers 156 can be pre-scored to form a weak spot such that upon heating the film can rupture at this weak spot and can continue to retract toward the sidewall. Alternatively, the film 156 can be configured to retract from the sidewall first, or some other location than from the center of the film 156. Furthermore, the film 156 can be attached to the sidewall all the way around the perimeter of the film and container interior or only partially attached thereto. Upon heating the container 151, the film 156 can shrink from the area of the pre-score i.e., the center in this aspect, and as the film 156 shrinks from the center it can continue to retract towards the sidewall, thus releasing the sandwich components 22*a* and 22*b*. Alternatively, a susceptor may be attached or applied to the film 156 and can be made of sputtered aluminum instead of or in addition to scoring, to aid in creating a break in the film 156 upon heating. The heat-shrink film layer 156 can be comprised of a biaxially oriented olefin layer such that it can advantageously partially control the direction of retraction of the film upon heating, although other thermoplastic film materials may also be used, such as polyester.

Figure 26A:
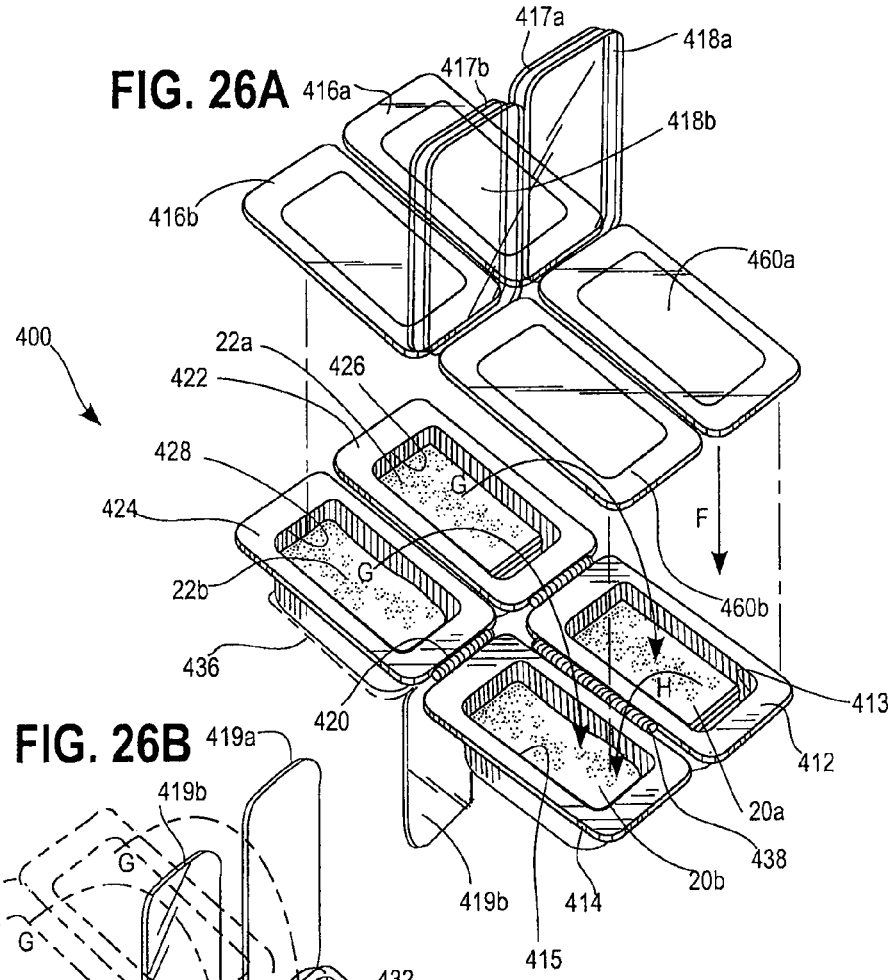
FIG. 26A is a perspective view of a sixth embodiment of a food package for segregating inner sandwich components of a sandwich before assembling.
Figure 26B:
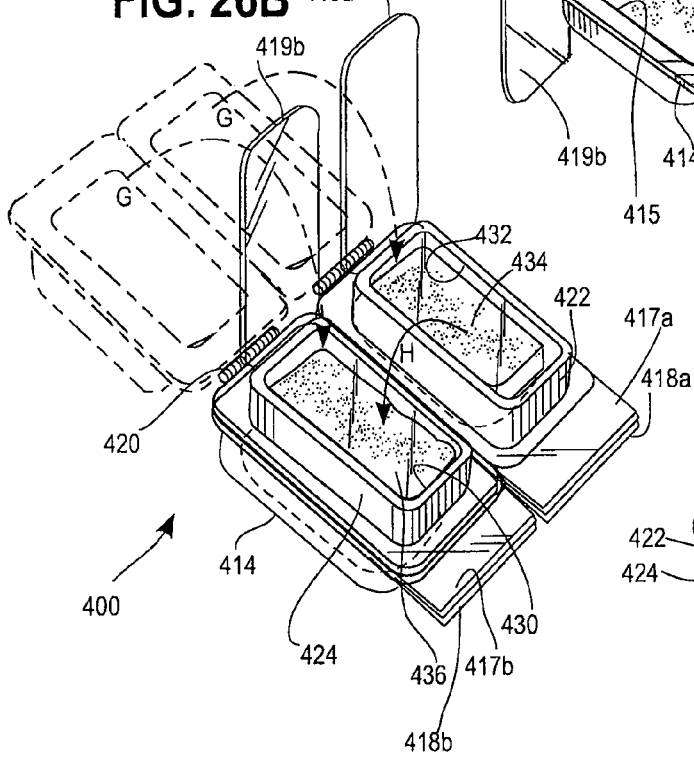
FIG. 26B is a perspective view of the package of FIG. 26A partially assembled.
Figure 26C:
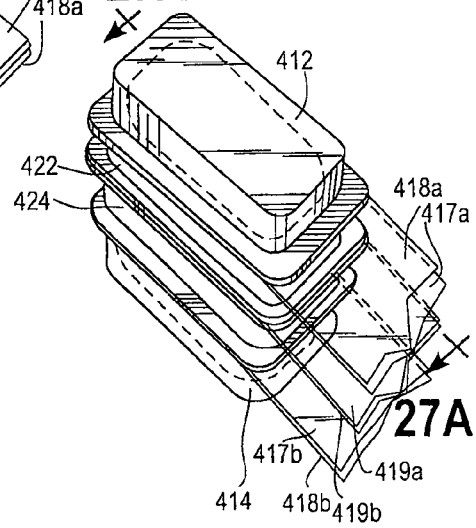
FIG. 26C is a perspective view of the package of FIG. 26A completely assembled.

Yet another embodiment of a food package can be provided where the inner sandwich components 22 and the bread components 20 are each separated in individual compartments, as shown in FIGS. 26A-C and 27A-B. The food package 400 is shown in a pre-assembled state in FIG. 26A, where the package 400 contains multiple compartments to store the food components. Preferably, each food component will have its own individual food compartment. Where there are four food components, as shown in FIGS. 26A-C, there can also be four compartments, one for each food component. For instance, there can be a top bread component 20*a* and a bottom bread component 20*b* stored in a top bread compartment 412 and a bottom bread compartment 414, respectively. Similarly, there can be two sandwich components 22*a* and 22*b* stored in a first sandwich compartment 422 and a second sandwich compartment 424, however more or less can be provided. In one aspect, the first sandwich component 22*a* can be a cheese product and the second sandwich component 22*b* can be a meat product, or vice versa. The two bread compartments 412 and 414 can be adjacent one another prior to assembly and can be connected via a hinge 438. The sandwich component compartments 422 and 424 can also be positioned adjacent one another when in the pre-assembled state shown in FIG. 26A, and can contact the bread compartments 412 and 414 along a common edge containing a connecting feature, such as a hinge 420. Further, the two sandwich compartments 422 and 424 can remain unconnected along their common edge.

The bread components 20*a* and 20*b* can each be stored in their own compartment 412 and 414, respectively, that can also generally conform to the shape of the bread components 20*a* and 20*b*. The bread compartments 412 and 414 can each have an open end 413 and 415, respectively, such that the compartments have one end wall with four sidewalls extending therefrom. The sandwich components can likewise each have their own individual compartments. A first sandwich component 22*a* can be stored in the first sandwich compartment 422 and a second sandwich component 22*b* can be stored in the second sandwich compartment 424. Each sandwich compartment 422 and 424 can be open on both ends, such that the compartments 422 and 424 comprise only four sidewalls around the sandwich components 22*a* and 22*b*. For instance, the first sandwich compartment 422 can have a first opening 426 opposite a second opening 432, and similarly the second sandwich compartment 424 can have a first opening 428 opposite a second opening 430. The openings 426 and 428 can each be defined by a flange or peripheral edge portion that connects all of the side wall portions.

Once the compartments are filled with their respective food components, their openings can be sealed with a peelable film layer or divider. Prior to filling, the sandwich compartments 422 and 424 can first have their second end openings 432 and 430, respectively, sealed with peelable film layers 434 and 436, respectively, to form a bottom surface onto which the sandwich components 22*a* and 22*b* can be filled. After filling the sandwich compartments 422 and 424, the first openings 426 and 428, respectively, can be sealed with a peelable film layer to close the compartments 422 and 424. This peelable film layer can comprise a single, common film layer that covers both openings 426 and 428 or, alternatively, it can comprise separate film layers 416*a* and 416*b* that each covers its respective compartment opening 426 and 428, as shown in FIG. 26A. Similarly, the bread compartments 412 and 414 can also be sealed with a peelable film layer 460*a* and 460*b*, respectively, which covers the openings 413 and 415, respectively. As shown in FIG. 26A, the bread film layer comprises two separate film layers 460*a* and 460*b*, but can also comprise a single, common layer covering each opening 413 and 415 simultaneously.

Additionally, the peelable film layers 416*a*, 416*b*, 434, 436, 460*a*, and 460*b* can all contain an extension of film which forms a pull tab that can be pulled to remove its respective film layer. For example, the bread film layer 460*a* can have an extension of film 418*a* which is positioned at approximately a right angle to the placement of the bread film layer 460*a* placed over the top bread compartment 412 before assembling the package 400. Likewise for the bottom bread compartment 414 and its associated film layers. Similarly, the first sandwich compartment film layer 416*a* can have an extension 417*a* that extends at approximately a right angle to its respective film layer 416*a* and further is adjacent the bread film extension 418*a* when folded. Likewise for the second sandwich compartment 424 and its associated film layers. Similarly, the second end opening film layers 434 and 436 of the sandwich compartments 422 and 424, respectively, can also contain an extension of film 419*a* and 419*b*, respectively, which can also be positioned at approximately a right angle to its respective film layers 434 and 436 before assembling the package 400. In the embodiment shown in FIGS. 26A-B, the second end opening film layers 434 and 436 each have their own individual pull tab extensions 419*a* and 419*b*, respectively, adjacent one another. Alternatively, they may also share a common pull tab extension. As will be explained herein, upon folding the package 400 into its assembled form the pull tab extensions can also be folded with the package compartments (i.e., can be folded onto or adjacent its respective film layer upper surface) to align and provide a common pull tab or protruding end portion 418.

Figure 27A:
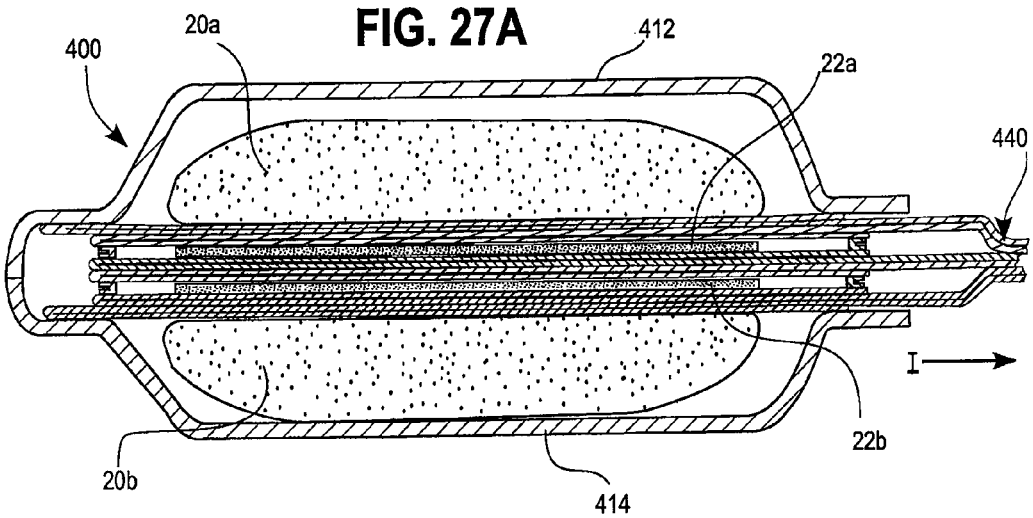
FIG. 27A is a cross-sectional view of the food package of FIG. 26C taken along the line 27A-27A.

To assemble the food package 400, the different compartments can be folded over and onto one another along their hinges to provide the assembled form shown in FIG. 27A. As shown in FIG. 26B, the sandwich compartments 422 and 424 can first be folded along hinge 420 positioned between the sandwich compartments 422 and 424 and the bread compartments 412 and 414, as indicated by arrows G so that the sandwich compartments 422 and 424 rest above and contact the bread compartments 412 and 414, respectively. For instance, the first sandwich compartment 422 can fold over and onto the first bread compartment 412 and the second sandwich compartment 424 can fold over and onto the second bread compartment 414.

Then, as shown in FIG. 26C, after the initial folding step, the two bread compartments 412 and 414 can be folded along the hinge 438 in the direction of arrow H such that the two bread compartments 412 and 414 are now located above one another with the sandwich compartments 422 and 424 therebetween, and further forming an outer container portion. Upon folding, the film extensions 417, 418, and 419 can all line up with one another on the same side of the folded food package 400 and can be secured together such as by heat-sealing to form a common pull tab 440, or protruding end portion, which provides for generally simultaneous opening of all of the film layers. Optionally, a handhold or grasping point can be added at the end of the tab 440 extending from the package 400. Additionally, the remaining free end of the pull tab 440 can also be folded back towards the underside of the package 400 (i.e., a bottom surface of the bottom bread compartment 414) for attachment to the underside of the package 400 during storage. As shown in FIG. 27A, once the package 400 is assembled the four food compartments are stacked on top of each other. The two bread compartments 412 and 414 are positioned on the outside with the two sandwich compartments 422 and 424 therebetween. Alternatively, there can be more or less sandwich compartments in the package 400.

Figure 27B:
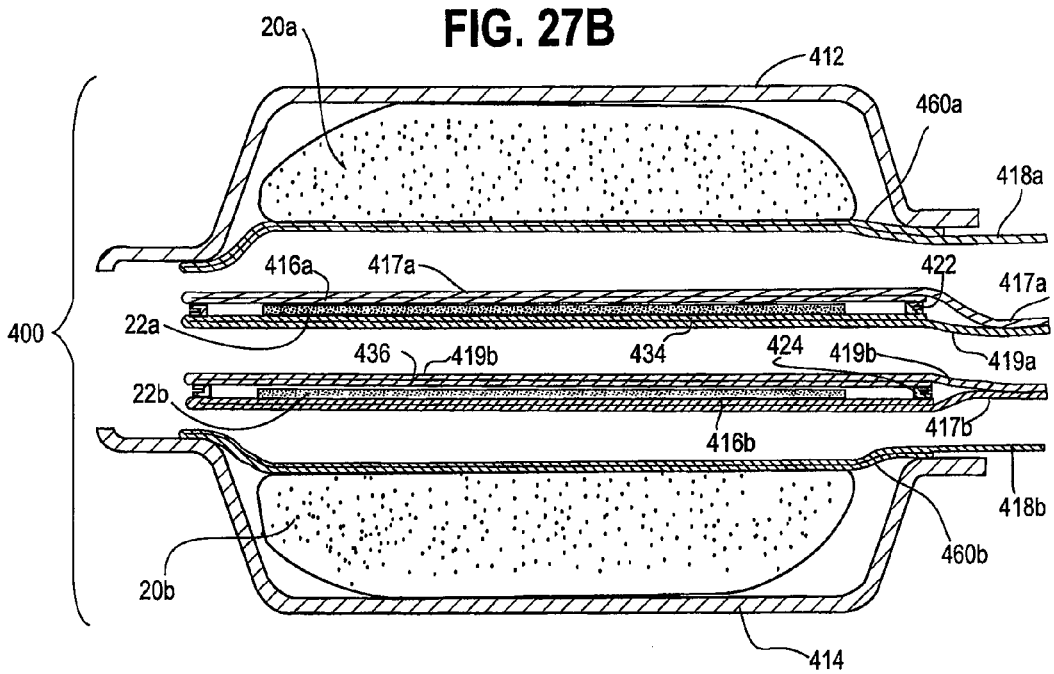
FIG. 27B is an exploded cross-sectional view of the food package of FIG. 27A.

Between adjacent food layers there can be at least one film layer separating the adjacent layers, and as further detailed in FIG. 27B, there are at least four film layers. For instance, a first bread component 20*a* that is positioned in the first bread compartment 412 can be adjacent a first sandwich compartment 422 including the first sandwich component 22*a* when folded into the assembled configuration. Separating the bread component 20*a* from the first sandwich component 22*a* are two film layers 460*a* and 416*a*, and two extension/pull tab layers 418*a* and 417*a*. The bread film layer 460*a* is closest to the bread component 20*a*, and the sandwich compartment film layer 416*a* is closest to the first sandwich component 22*a*, separated by pull tab extensions 417*a* and 418 located therebetween. Similarly, the second sandwich component 22*b* located in the second sandwich compartment 424 is adjacent the second bread compartment 414 with four film layers therebetween. The sandwich compartment film layer 416*b* is closest to the sandwich compartment 424 and the bread film layer 460*b* is closest to the bread compartment 414, with these two film layers being separated by two pull tab extension layers 417*b* and 418*b*, one for each layer.

Between the two sandwich compartments 422 and 424 the second opening film layers 434 and 436 are also separated by their associated pull tab film layers 419*a* and 419*b*, such that the first sandwich compartment film layer 434 is adjacent the second opening 432 of the first sandwich compartment 422 and the second sandwich compartment film layer 436 is adjacent the second opening 430 of the second sandwich compartment 424. Furthermore, the pull tab film extension can be an extension of its associated film layer forming a continuous layer, such that the film layer covering the opening of the compartment is folded back upon itself and extends across its surface to form the pull-tab or, alternatively, the pull-tab may be attached to the film layer as a separate film.

To open the food package 400, the common pull tab 440 can be pulled in the direction of arrow I which begins removal of each film layer. Upon opening, the film layers utilize a rolling peel motion to separate the layers, as described in previous embodiments, thus allowing for release of the film layers from the sandwich components in a peeling motion rather than a sliding motion.

Although the above embodiment was described in terms of bread components and sandwich components, it may be used with any type of food product that contains component parts that need to be segregated inside of packaging. For instance, a first food component and a second food component can be provided, which may comprise bread components or any other food, with at least one intermediate food component therebetween, where the intermediate food component can comprise a sandwich component or any other food. At least three compartments can be provided where there is one intermediate food component.

The material of construction of the outer container 15, 115, 215 or 315 can be any rigid plastic material typically used to package food items and can be a multilayer system to provide a moisture and gas resistant polymer film, such as polyester (PET), EVOH, EVA, high-density polyethylene (HDPE), polyvinyl chloride (PVC), polypropylene, polystyrene, high impact polystyrene, or any combination thereof, but can also be a flexible film material as well which can be opened using a rolling peel action but can also be opened using other techniques. Preferably, PET can be used. The material of construction of the flexible envelopes 16 can be any flexible plastic or paper material typically used to package food items and can be a single layer or multilayer system to provide a moisture and gas resistant polymer film, such as nylon, EVOH, polyethylene (PE), OPET, EVA, polypropylene, polyvinylidene chloride (PVDC), an ionomer layer, or any combination thereof. Preferably, a multilayer system comprising OPET/PE/EVOH/EVA can be used. Where an outer sleeve 24 is used to wrap around the outer surface of the rigid container it may comprise paperboard, plastic or other similar package components.

The rupturable seals 28 of the envelope 16 can be formed in a variety of manners, such as by applying a food-grade adhesive between or to the layers and/or by heat sealing the layers together. The dimensions of the envelope may range from about 1 inch by about 2 inches to about 8 inches by about 20 inches, and preferably are about 3 inches by about 5.5 inches. The shape of the envelopes 16 may be any shape that compliments the food and/or the sandwich 20 such as circular, oval, rectangular, square, and the like. For instance, where the bread component is a round bun, it may be preferable to have a circular envelope. Similarly, where the bread component is a rectangular "sub-style" sandwich it may be preferable to have rectangular-shaped envelopes 16. The protruding end portion 18, 18', 118, 218, 318, or 181 can have any thickness that is amenable to withstanding a pulling force necessary to peel the seals 28 of the envelope 16 apart. The length of the protruding end portion similarly needs to be long enough to adequately provide the necessary pulling force to peel the envelopes 16 apart and long enough to pull the ruptured envelopes 16 out of the sandwich 20 and out of the container. Typically, the protruding end portion will be at least as long as the length (or diameter, where circular) of the side of the rigid container that contains the opening for the protruding end portion and ruptured layers to pass through.

The dimensions of the outer container can vary due to the many different sized and shaped sandwiches that are possible. Preferably, a rigid outer container will compliment the shape of the bread component. Therefore, dimensions can range from about 2 inches by about 5 inches to about 9 inches by about 21 inches, and preferably may be about 4.5 inches by about 7.5 inches. The bread component of the sandwich may comprise a bread, a roll, a wrap, or any other farinaceous product typically used to make a sandwich. The inner sandwich component, or garnish, may comprise cheese, meat, bacon, lettuce, tomatoes, peppers, pickles, other vegetables, or any other substantially solid food component used as a garnish or topping for a sandwich.

A method is disclosed herein for opening a pre-assembled sandwich, as shown in FIGS. 1-6. FIGS. 1 and 4 depict the sandwich 20 in its packaged state, prior to opening and consuming the sandwich 20. The rigid container 15 can be contained within a sleeve 24, as shown in FIGS. 1 and 4, or it may not be contained within a sleeve. The rigid container 15 can be closed such that the top compartment 12 is placed in contact with the bottom compartment 14, creating an enclosure about the sandwich 20. The top compartment 12 and the bottom compartment 14 can contact each other at outer peripheral flange portions 121 and 141, respectively. Inside of the closed rigid container 15 is the sandwich 20 having the sandwich components 22, e.g., garnish or toppings, enveloped inside its respective envelope 16. Protruding through an opening or slot between the top compartment 12 and the bottom compartment 14 is a portion of the protruding end portion 18.

In FIGS. 2 and 5, an end segment 38 of the protruding end portion 18 can be grasped and pulled in the direction of arrow A. As the protruding end portion 18 is being pulled in direction A, the flexible envelope 16 can begin to separate into two separate layers 16*a* and 16*b* by peeling along its rupturable seals 28. As the seals 28 peel apart, the sandwich component 22 becomes exposed to the inner surfaces of the sandwich 20. Once all of the layers of the flexible envelope 16 have been removed from the sandwich 20 and the container 15, as in FIGS. 3 and 6, the sandwich components 22 are exposed to the adjacent component or components, whether it be an adjacent sandwich 22 or bread component 20*a* and/or 20*b*, or both. As the envelopes 16 are pulled away and separated, they pull away from their respective sandwich components 22 and the sandwich components 22 are relatively automatically assembled into a sandwich 20 due to the force of gravity acting upon the sandwich components 22.

As the sandwich components 22 are being removed from their respective envelopes 16, the rigid container 15 can be removed relatively simultaneously from the sleeve 24 by grasping a grip tab 26, if one is present, and pulling in the direction of arrow B. The grip tab 26 can be grasped and pulled at relatively the same time as the protruding end portion 18 is grasped and pulled, to provide for substantially a "one-step" opening method. Optionally, the grip tab 26 may also include a finger hole (not shown), for additional support upon pulling. The container 15 can then be opened and the sandwich eaten. The opened layers 16*a* and 16*b* of the envelope 16 can remain in the inside of the sleeve 24, where they are relatively unseen by the consumer, and do not require any further action by the consumer to collect and/or discard the layers 16*a* and 16*b* of the envelope 16.

In the additional embodiments that do not contain a pull tab or visible end segment of the protruding end portion 218, such as in FIGS. 20 and 21, the knob or spool 230 can be rotated to activate the protruding end portion 218 in order to peel the seals 28 of the envelope 16 apart. The knob 230 can contain the protruding end portion 218 wrapped around the spool of the knob 230 such that as the knob 230 is rotated in an axial direction, the protruding end portion 218 is further wrapped around the knob 230, thus applying a pulling force to the envelope 16 within the sandwich. The envelope 16 can be peelable in a similar manner as above, however, the ruptured layers will also wrap about the spool or knob 230 as the protruding end portion 218 does once pulled from the sandwich and container 215.

From the foregoing, it will be appreciated a food package for segregating ingredients of a multi-component food product is provided such that numerous modifications and variations could be made thereto by those skilled in the art without departing from the scope of the package set forth in the claims. Therefore, the disclosure is not limited to the aspects and embodiments described hereinabove, or to any particular embodiments. Various modifications to the segregating food package can result in substantially the same container and various other modifications to the method of opening the package could be made.

What is claimed is:

1. A package containing a food product and configured for segregating components of the food product, the food product having a first food component and a second food component and an intermediate food component therebetween, the package comprising:

an outer container having a top compartment for the first food component and a bottom compartment for the second food component arranged in a closed configuration;

a flexible envelope for enclosing the intermediate food component, the flexible envelope having an upper layer and a bottom layer with a rupturable seal therebetween; and a protruding end portion extending through an opening in the outer container and connected to a portion of the flexible envelope, the envelope layers configured to peel apart and be removed from the outer container in the closed configuration as the protruding end portion is pulled away from the container to expose all surfaces of the intermediate food component while the outer container remains in the closed configuration.

2. The package according to claim 1, wherein the upper and bottom layers of the envelope roll back upon themselves in a peeling action as the protruding end portion is pulled away from the container resulting in at least two ruptured envelope layers.

3. The package according to claim 1, wherein the protruding end portion has at least a first layer extending from the upper layer of the envelope and at least a second layer extending from the bottom layer of the envelope, where the first and second layers each has an end portion that extends across the envelope and terminates at the protruding end portion.

4. The package according to claim 3, wherein the first and second layers of the protruding end portion extend from an end of the envelope opposite the protruding end portion.

5. The package according to claim 4, wherein the first layer is an extension of its respective upper layer and the second layer is an extension of its respective lower layer, thus each comprising one continuous layer.

6. The package according to claim 4, wherein the first and second layers are not wider than the end of the envelope to which the first and second layers are affixed.

7. The package according to claim 3, wherein the outer container has peripheral flanges such that the top compartment and the bottom compartment contact each other at the peripheral flanges.

8. The package according to claim 7, wherein at least one of the top and bottom compartments has a compartment film layer extending across an opening thereat and sealed to the peripheral flanges of the top or bottom compartment.

9. The package according to claim 8, wherein the protruding end portion has a third layer extending from one side of the compartment film layer and across the opening of the top or bottom compartment, the third layer further having an end portion that extends beyond the food product and outer container into the protruding end portion.

10. The package according to claim 8, wherein a first of the upper or lower layers is at least partially sealed to the compartment film layer.

11. The package according to claim 10, wherein a second of the upper or lower layers is sealed to the first of the upper or lower layers.

12. The package according to claim 11, wherein one of the upper or lower layers is sealed to the compartment film layer about a periphery of the compartment film layer except for at least an area adjacent a third layer extending from one side of the compartment film layer and into the protruding end portion.

13. The package according to claim 12, wherein each of the upper, lower, and compartment film layers begins to peel and rupture their seals at different times.

14. The package according to claim 7, wherein at least one of the upper layer and bottom layer of the envelope is sealed to the peripheral flanges of either the top or bottom compartment, and the other of the upper layer and bottom layer is sealed to the other.

15. The package according to claim 1, wherein the protruding end portion extends between the top compartment and the bottom compartment.

16. The package according to claim 1, wherein the package further comprises an outer sleeve surrounding the outer container.

17. The package according to claim 16, wherein the protruding end portion has a tail that protrudes through the outer sleeve.

18. The package according to claim 1, wherein a second envelope encloses an additional intermediate food component and both the first and second envelopes can be opened together.

19. The package according to claim 1, wherein the protruding end portion is attached to a roller.

20. The package according to claim 19, wherein the roller has a tab that is pulled to activate the roller along one side of the package and the ruptured envelope layers are wound upon the roller.

21. The package according to claim 1, wherein the top compartment and the bottom compartment are integrally connected along a portion of a side by a hinge.

22. The package according to claim 1, wherein the protruding end portion extends in a secondary compartment of the outer container outwardly from one of the top and bottom compartments.

23. The package according to claim 22, wherein the ruptured envelope layers are pulled into the secondary compartment.

24. The package according to claim 1, wherein the protruding end portion is attached to a rotating spool mounted to the container.

25. The package according to claim 24, wherein the ruptured envelope layers are rolled up along the spool as a knob integral with the spool is turned.

26. The package according to claim 1, wherein the flexible envelope further has a middle layer between the upper and bottom layers, to which a portion of the upper and bottom layers are sealed.

27. The package according to claim 26, wherein the middle layer has an opening therein through which the intermediate food component is positioned, partially surrounded by an outer frame of the middle layer to which the upper and bottom layers are sealed.

28. The package according to claim 1, wherein a side portion of the envelope contains an opening therein over which a flap portion is affixed, the flap portion further having a protruding end portion.

29. The package according to claim 28, wherein an end of the envelope opposite the opening contains a second protruding strip portion.

30. The package according to claim 1, wherein the protruding end portion is formed of a portion of at least one of the upper or lower layers of the envelope separated from the remainder of the envelope by one or more areas of weakness.

31. The package according to claim 1, wherein the rupturable seal extends substantially entirely about a perimeter of the envelope.

32. The package according to claim 1, wherein the first and second food components are a pair of bread components.

33. The package according to claim 1, wherein the food product is a sandwich.

* * * * *